US007631585B2

(12) United States Patent
Ichikawa et al.

(10) Patent No.: US 7,631,585 B2
(45) Date of Patent: Dec. 15, 2009

(54) KICKBACK-INHIBITING DEVICES FOR CUTTING DEVICES

(75) Inventors: Kiyotaka Ichikawa, Anjo (JP); Katsuhiko Sasaki, Anjo (JP); Yoshinori Shibata, Anjo (JP)

(73) Assignee: Makita Corporation, Anjo (JP)

( * ) Notice: Subject to any disclaimer, the term of this patent is extended or adjusted under 35 U.S.C. 154(b) by 350 days.

(21) Appl. No.: 11/213,801

(22) Filed: Aug. 30, 2005

(65) Prior Publication Data

US 2006/0042441 A1 Mar. 2, 2006

(30) Foreign Application Priority Data

Aug. 31, 2004 (JP) ..... 2004-252368

(51) Int. Cl.
*B27G 19/00* (2006.01)
*B27G 19/02* (2006.01)

(52) U.S. Cl. ..... 83/102.1; 83/440.2; 83/447; 83/478; 83/477.2; 83/698.11

(58) Field of Classification Search ..... 83/102.1, 83/477.2, 450, 650, 478, 446, 440.2, 425, 83/447, 698.61, 698.31, 698.21; 144/253.6; 403/96

See application file for complete search history.

(56) References Cited

U.S. PATENT DOCUMENTS

| | | | | | |
|---|---|---|---|---|---|
| 545,504 | A * | 9/1895 | Hoover | 83/102.1 |
| 997,720 | A * | 7/1911 | Thouprnat | 83/102.1 |
| 1,082,870 | A * | 12/1913 | Humason | 83/440.2 |
| 1,428,986 | A * | 9/1922 | Smith | 83/102.1 |
| 1,430,983 | A * | 10/1922 | Wilhelm | 83/860 |
| 2,095,330 | A * | 10/1937 | Hedgpeth | 83/102.1 |
| 2,257,459 | A * | 9/1941 | Gardner | 83/102.1 |
| 2,466,325 | A * | 4/1949 | Ocenasek | 83/102.1 |
| 2,593,596 | A * | 4/1952 | Olson | 83/102.1 |
| 2,731,049 | A * | 1/1956 | Akin | 83/478 |
| 2,750,970 | A * | 6/1956 | Gaskell | 83/478 |
| 3,232,326 | A * | 2/1966 | Speer et al. | 83/102.1 |
| 4,418,597 | A * | 12/1983 | Krusemark et al. | 83/478 |
| 4,615,247 | A * | 10/1986 | Berkeley | 83/102.1 |
| 4,625,604 | A * | 12/1986 | Handler et al. | 83/102.1 |
| 5,287,779 | A * | 2/1994 | Metzger, Jr. | 83/102.1 |
| 6,405,624 | B2 | 6/2002 | Sutton | |
| 6,578,460 | B2 * | 6/2003 | Sartori | 83/100 |
| 2004/0255745 | A1 * | 12/2004 | Peot et al. | 83/102.1 |
| 2006/0101962 | A1 * | 5/2006 | Garcia | 83/102.1 |

FOREIGN PATENT DOCUMENTS

| | | |
|---|---|---|
| JP | U 3-42602 | 4/1991 |

* cited by examiner

*Primary Examiner*—Boyer D. Ashley
*Assistant Examiner*—Laura M. Lee
(74) *Attorney, Agent, or Firm*—Oliff & Berridge, PLC

(57) ABSTRACT

A kickback-inhibiting device serves to inhibit a workpiece from being lifted up by a rotating cutting blade of a cutting device. The kickback-inhibiting devices include kickback-inhibiting members and a holding device. Each of the kickback-inhibiting members is movable between an operative position and an inoperative position. In the operative position, each kickback-inhibiting member is operable to engage the workpiece from an upper side in order to inhibit the workpiece from being lifted up. In the inoperative position, each kickback-inhibiting member is positioned upwardly away from the workpiece so as not to interact with the workpiece. The holding device serves to hold the kickback-inhibiting members in the inoperative positions.

4 Claims, 22 Drawing Sheets

KICKBACK-INHIBITING DEVICES FOR CUTTING DEVICES

This application claims priority to Japanese patent application serial number 2004-252368, the contents of which are incorporated herein by reference.

BACKGROUND OF THE INVENTION

1. Field of the Invention

The present invention relates to kickback-inhibiting component for cutting devices. More specifically, the present invention relates to kickback-inhibiting devices for inhibiting workpieces from being lifted up by the impact force produced though contact with the cutting blades of cutting devices, such as table saws, which cutting blades may still be rotating at a high speed immediately after the workpieces have been cut.

For example, table saws have a circular saw blade that partly extends upward from a table on which workpieces are to be placed. Moving the workpiece along the table relative to the saw blade may perform the cutting operation. In the case of table saws, or with cutting devices in which the cutting operation is performed in the same manner as with table saws, the cutting blade (e.g., saw blade) rotates such that the front side of the cutting blade (with respect to the moving direction of the workpiece during the cutting operation) moves downward while the rear side of the cutting blade moves upward. Therefore, if the workpiece contacts with the rear side of the rotating cutting blade immediately after forming the kerf (i.e., immediately after cutting the workpiece), the workpiece may possibly be lifted up or kicked back by the rotating cutting blade. When this occurs, it is difficult to perform a smooth cutting operation.

Therefore, there has been proposed to provide a flat plate (which may be called a "riving knife") that has a thickness substantially equal to the thickness of the cutting blade. The riving knife is positioned in alignment with the cutting blade on the rear side of the cutting blade. The riving knife may enter the kerf during the cutting operation to ensure that the width of the kerf is maintained at more than a predetermined width in order to inhibit unintended contact of the cutting blade with the workpiece. In addition, there has been proposed to provide kickback-inhibiting claws that are disposed on either side of the riving knife within a range so as to not interfere with the movement of the workpiece. The kickback-inhibiting claws are provided in order to inhibit the workpiece from being lifted up. Such techniques are disclosed, for example, in Japanese Laid-open Utility Model Publication No. 3-42602 and U.S. Pat. No. 6,405,624.

Because the claws engage with the upper surface of the workpiece in order to inhibit the kickback phenomenon, some problems have been observed. If a decorative plywood board workpiece were to be cut, in some cases it would be preferable for the kickback-inhibiting claws to not come into contact with the surface of the workpiece in order to inhibit or minimize the possibility of the workpiece being damaged by the claws. In such a case, it is necessary to remove the kickback-inhibiting claws or to move the claws to a position where the claws do not contact the workpiece. However, the known kickback-inhibiting claws have not been designed to take these problems into account. Therefore, the known kickback-inhibiting claws cannot be easily moved and maintained in a position where the claws do not contact the workpiece. In addition, the known claws cannot be easily removed. As a result, it is difficult to practically use a cutting device incorporating kickback-inhibiting claws in order to cut decorative plywood board or the like.

SUMMARY OF THE INVENTION

It is accordingly an object of the present invention to teach improved kickback-inhibiting devices that are improved in operability.

In one aspect of the present teachings, kickback-inhibiting devices for inhibiting a workpiece from being lifted up by a cutting blade of a cutting device are taught. The cutting blade may partly extend upward from an upper surface of a table used for placing the workpiece thereon. The kickback-inhibiting devices may include a kickback-inhibiting member(s) and a holding device. The kickback-inhibiting member(s) may be movable between an operative position and an inoperative position. In the operative position, the kickback-inhibiting member(s) is operable to engage the workpiece from an upper side in order to inhibit the workpiece from being lifted up. In the inoperative position, the kickback-inhibiting member(s) is positioned upwardly away from the workpiece so as to not interact with the workpiece. The holding device serves to hold the kickback-inhibiting member(s) in the inoperative positions.

With this arrangement, the kickback-inhibiting member(s) can be held in an inoperative position where the kickback-inhibiting member(s) does not interact with the workpiece. Therefore, the cutting operation of a decorative plywood panel or the like can be performed without causing damage to the surface of the panel. The kickback-inhibiting member(s) may be moved from the inoperative position to the operative position by releasing the holding device so that the kickback-inhibiting member(s) may operate to inhibit any kickback phenomenon of the workpiece during the cutting operation.

In one embodiment, the kickback-inhibiting devices further include a riving knife disposed on a rear side of the cutting blade as viewed in the cutting direction of the workpiece and aligned with the cutting blade. The kickback-inhibiting member(s) may be vertically pivotally supported on the riving knife. The holding device is disposed on the riving knife and serves to hold the kickback-inhibiting member(s) in an inoperative position when the kickback-inhibiting member(s) has been pivoted upward to reach the inoperative position.

In another embodiment, the kickback-inhibiting member(s) is vertically pivotally supported on the riving knife via a pivotal shaft. The kickback-inhibiting device further includes an operation lever vertically pivotally supported on the riving knife via the pivotal shaft but independently of the kickback-inhibiting member(s). The operation lever is operable to pivot the at least one kickback-inhibiting member from an operative position to the inoperative position. The holding device is operable to engage the operation lever with the riving knife when the kickback-inhibiting member(s) has moved to an inoperative position.

Because the operator can pivot the kickback-inhibiting member(s) by the pivotal operation of the lever, it is not necessary for the operator to directly handle the kickback-inhibiting member(s) in order to pivot the same. Therefore, it is possible to easily and rapidly pivot the kickback-inhibiting member(s).

In a further embodiment, the holding device is operable to hold the kickback-inhibiting member(s) in any of a plurality of inoperative positions. Therefore, the operator can selectively choose the desired inoperative position. For example, the operator may select an inoperative position that is no further away than necessary from the operative position in response to the thickness of the workpiece to be cut. Therefore, the kickback-inhibiting member(s) can be rapidly moved to the inoperative position.

In a still further embodiment, the kickback-inhibiting devices may further include an operation lever slidably movably mounted to the riving knife along the cutting direction. This allows the kickback-inhibiting member(s) to move upward from an operative position to an inoperative position as the slide operation lever is moved in one direction along the cutting direction. The operation lever may be configured to cover the kickback-inhibiting member(s) from at least the upper side and opposite lateral sides when the kickback-inhibiting member(s) is positioned in an inoperative position.

With this arrangement, the kickback-inhibiting member(s) can be moved from an operative position to an inoperative position by a simple sliding operation of the operation lever. In addition, because the operation lever covers the kickback-inhibiting member(s) when the kickback-inhibiting member(s) is in an inoperative position, it is possible to reliably inhibit the kickback-inhibiting member(s) from interacting with other parts of the cutting device or other articles.

In another aspect of the present teachings, kickback-inhibiting devices are taught for inhibiting a workpiece from being lifted up by a cutting blade of a cutting device. The cutting blade partly extends upward from an upper surface of a table used for placing the workpiece thereon. The kickback-inhibiting devices may include a riving knife, a kickback-inhibiting member(s), and a mounting device. The riving knife may be disposed on a rear side of the cutting blade as viewed in a cutting direction of the workpiece and may be aligned with the cutting blade. The kickback-inhibiting member(s) may be operable to engage the workpiece from an upper side in order to inhibit the workpiece from being lifted up. The mounting device may be operable to removably mount the kickback-inhibiting member(s) to the riving knife.

With this arrangement, the workpiece can be reliably prevented from being damaged by the kickback-inhibiting member(s) because the kickback-inhibiting member(s) can be completely removed from the riving knife. In addition, the removal of the kickback-inhibiting member(s) may allow the cutting device to be able to perform a groove forming operation upon the workpiece.

In one embodiment, the riving knife has a first recess and a second recess formed therein. The first recess is open at an edge of the riving knife and has a first length. The second recess is formed in continuity with the first recess and has a second length greater than the first length. The mounting device includes a first mounting member and a second mounting member that are insertable into the second recess and are movable towards and away from each other in a direction along the second length. The mounting device further includes a lock lever operable to wedge between thee first and second mounting members and to withdraw from a position between the first and second mounting members. The first and second mounting members can be fixed in position relative to the riving knife when the first and second mounting members are moved away from each other so as to fix them in position relative to the second recess. At this point, the first and second mounting members are prevented from being removed from the second recess to outside of the first recess due to the wedging of the lock lever between the first and second mounting members. Conversely, the first and second members can be removed from the riving knife when the first and second mounting members are moved towards each other. This enables the movement from the second recess to outside of the first recess due to the withdrawal of the lock lever from a position between the first and second members.

In this way, the first and second mounting members may not pass through the first recess when they are moved apart from each other within the second recess, because the length of the first recess is smaller than the length of the second recess. However, the first and second mounting members may pass through the first recess when they are moved towards each other. Therefore, the kickback-inhibiting member(s) can be mounted to and removed from the riving knife by a relatively simple operation of moving the first and second mounting members of the mounting device towards and away from each other.

DETAILED DESCRIPTION OF THE INVENTION

Each of the additional features and teachings disclosed above and below may be utilized separately or in conjunction with other features and teachings to provide improved kickback-inhibiting devices and cutting devices having such kickback-inhibiting devices. Representative examples of the present invention, which examples utilize many of these additional features and teachings both separately and in conjunction with one another, will now be described in detail with reference to the drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

First Representative Embodiment

Figure 1:
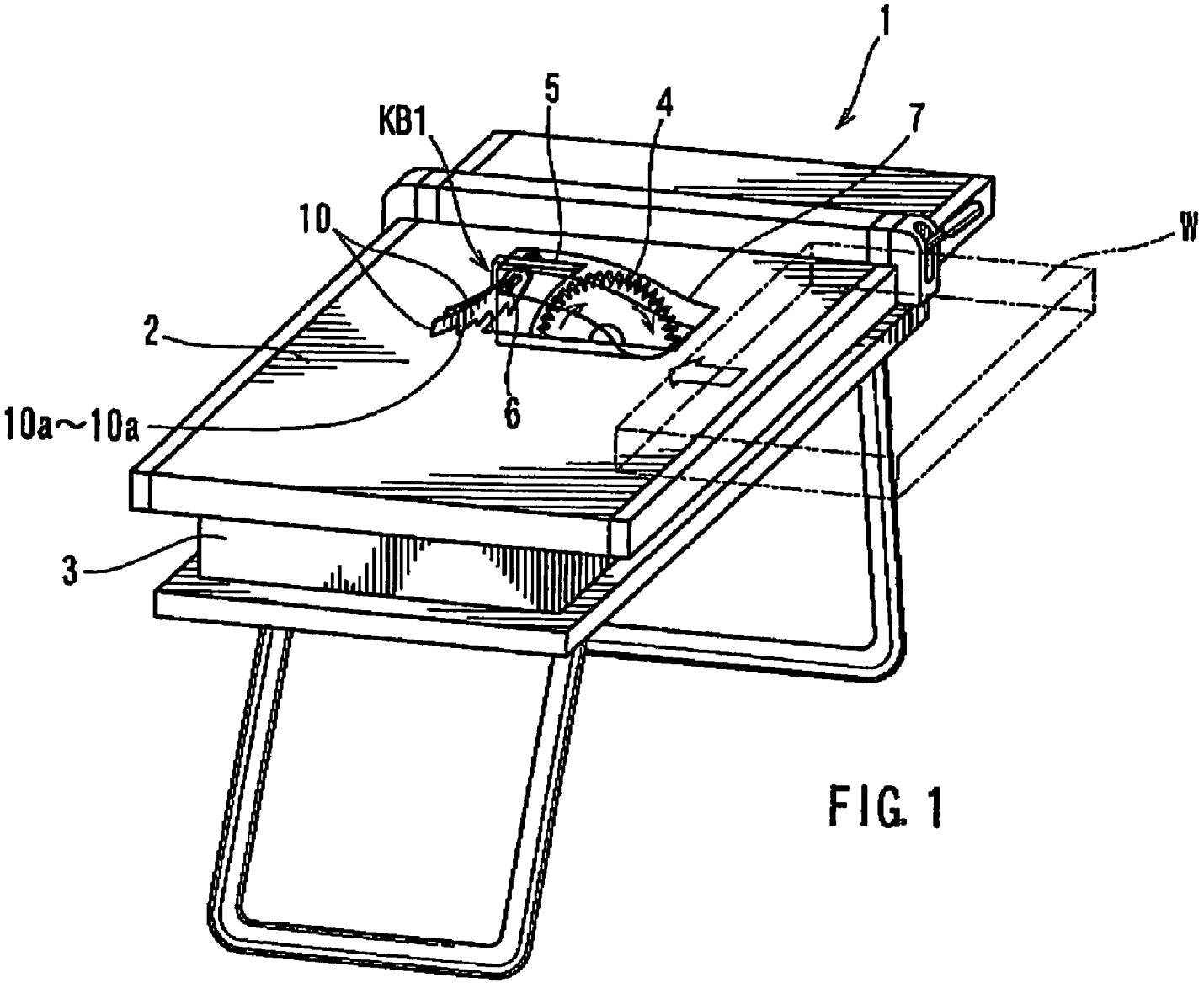
FIG. 1 is a perspective view of a table saw incorporating a first kickback-inhibiting device according to a first representative embodiment.

A first representative embodiment of the present invention will now be described with reference to FIGS. 1 to 4. Referring to FIG. 1, a cutting device 1 is shown incorporating a representative kickback-inhibiting device KB1. The construction of the cutting device 1 is the same as for a known cutting device except for the kickback-inhibiting device KB1 and the construction related to the kickback-inhibiting device KB1. Therefore, the cutting device 1 will be described in brief.

The cutting device 1 has a table 7, on which a workpiece W is placed for cutting. The base 3 supports the table 2 so that the table 2 extends in a horizontal direction. A circular cutting blade 4 is disposed within a central portion of the table 3 such that an upper portion of the cutting blade 4 extends upward from the upper surface of the table 2. A driving device (not shown), which may include a motor as a drive source, rotatably drives the circular cutting blade 4.

In order to cut the workpiece W, the workpiece W may be moved relative to the cutting blade 4 along the upper surface of the table 2 in a cutting direction, as indicated by an outline arrow (i.e., right to left). A riving knife 5 is disposed on the rear side (left side as viewed in FIG. 1) of the cutting blade 4 with respect to the cutting direction.

In the case in which the cutting blade 4 is a type of saw called a "chip saw" (a chip saw may have a disk-like metal base and a plurality of chips attached to the peripheral edge of metal base), the riving knife 4 may be a flat plate having a thickness greater than the thickness of the metal base but smaller than the thickness of the peripheral chips. The riving knife 5 may be supported by the base 3 and may have an upper portion that extends upward from the upper surface of the table 2 in the same manner as the cutting blade 4. The riving knife 5 may enter the kerf of the workpiece W immediately after such a kerf has been formed. The riving knife 5 may hold the kerf so as to maintain a predetermined width. In this way, the workpiece W may be prevented from unintentionally contacting the cutting blade 4 at the kerf, so that the kickback phenomenon of the workpiece may be inhibited or minimized.

Figure 2:
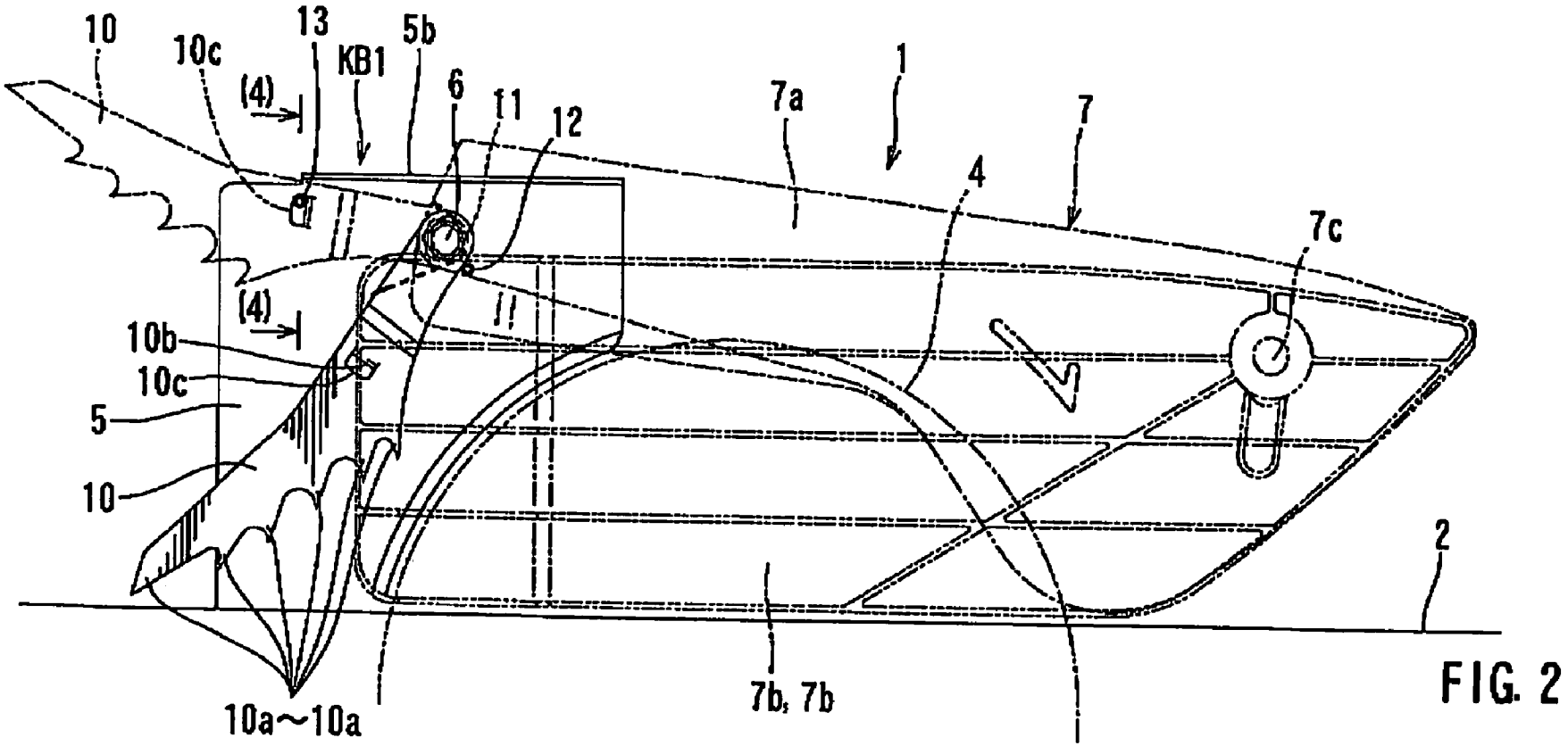
FIG. 2 is a side view of the kickback-inhibiting device of FIG. 1.
Figure 3:
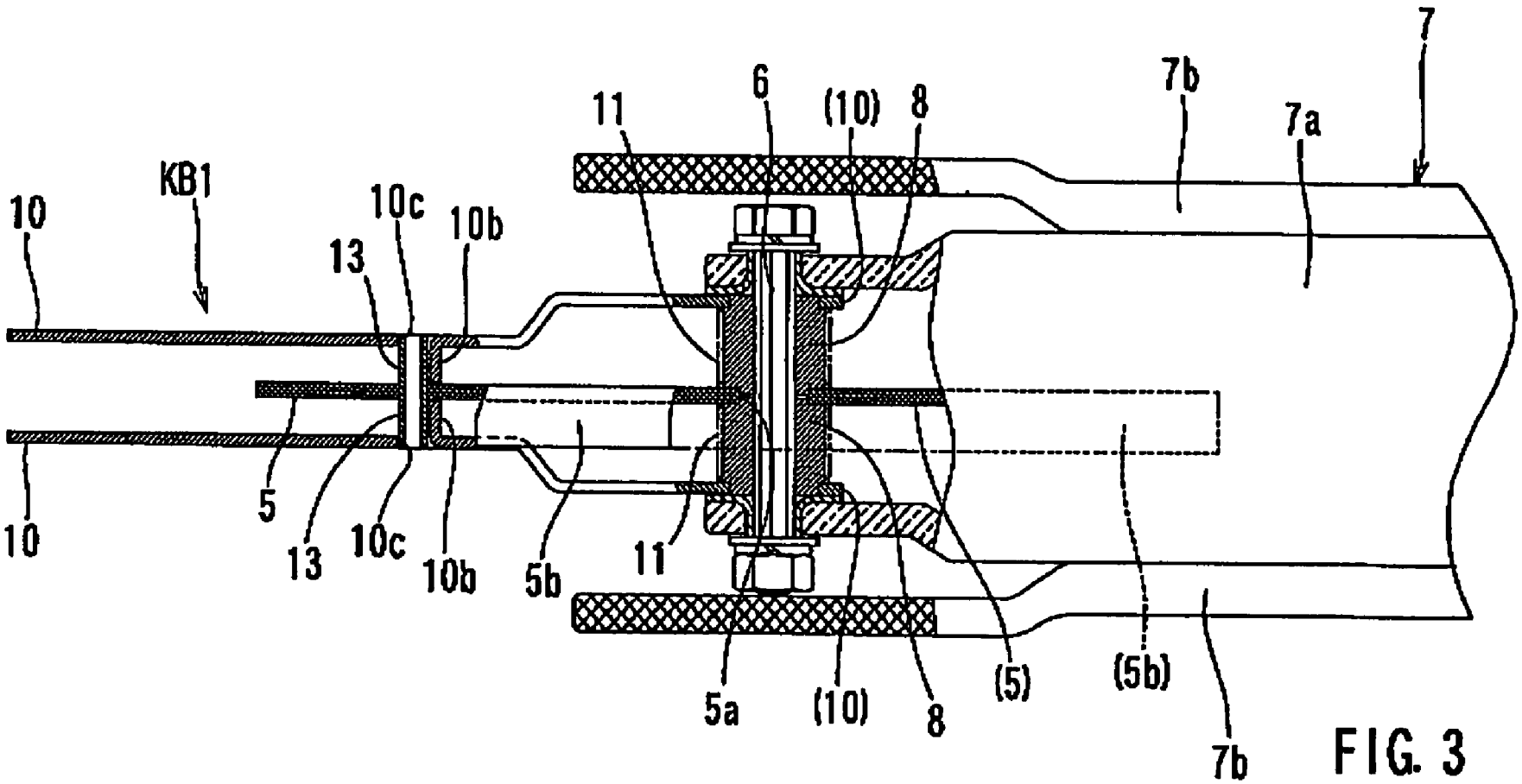
FIG. 3 is a top plan view of the kickback-inhibiting device of FIG. 1 with a portion shown in horizontal cross-section.
Figure 4:
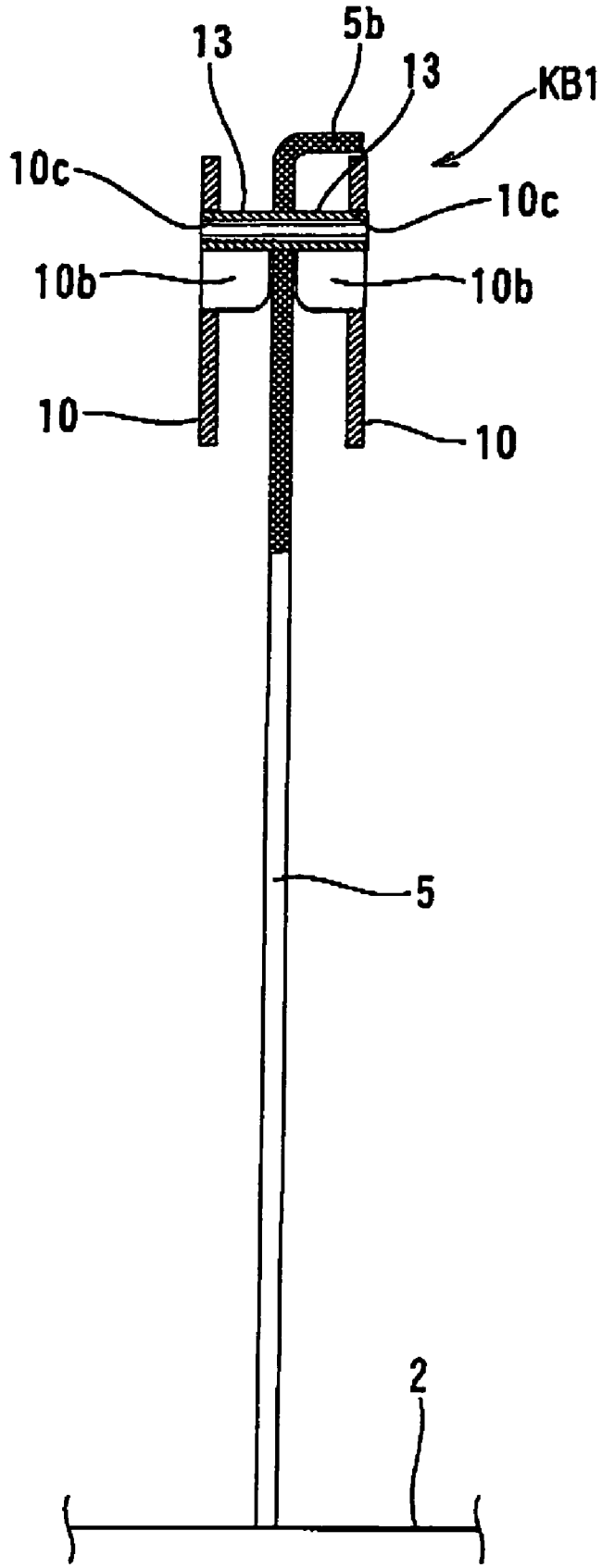
FIG. 4 is a cross-sectional plan view taken along line (4)-(4) in FIG. 2 and showing the kickback-inhibiting device in an inoperative position as viewed from the rear side in a direction opposing the cutting direction.

A cover 7 and the representative kickback-inhibiting device KB1 may be mounted to the riving knife 5. More specifically, the kickback-inhibiting device KB1 may have a pair of kickback-inhibiting members 10 that is vertically pivotally supported together with the cover 7 by the riving knife 5 via a pivotal shaft 6. The details of the pivotal support structure of the riving knife 5 are shown in FIGS. 2 to 4.

The cover 7 may have a substantially inverted U-shaped cross-section and is separated into an upper portion 7*a*, primarily covering the upper side of the cutting blade 4, and right and left side portions 7*b* extending downward from opposite sides of the upper portion 7*a* in order to cover either side of the cutting blade 4. The riving knife 5 vertically pivotally supports the rear part of the upper portion 7*a* via the pivotal shaft 6. The right and left side portions 7*b* are vertically pivotally joined to the front part of the upper potion 7*a* via a pivotal shaft 7*c*.

In this way, the upper portion of the cutting blade 4 extending upward beyond the upper surface of the table 2 is covered from the upper side and both lateral sides. The cover 7 may move to expose the upper portion of the cutting blade 4 as the workpiece W enters between the cover 7 and the upper surface of the table 2 during a cutting operation. In addition, during a cutting operation, the cover 7 may be held in such a way as to rest on the upper surface of the workpiece W. As a result, the cutting chips that may be produced by the cutting operation may be inhibited from scattering to the surrounding environment.

The rear part of the upper portion 7*a* of the cover 7 is supported on the upper portion of the riving knife 5 by the pivotal shaft 6 via retainer sleeves 8. The retainer sleeves 8 are fitted from opposite sides into a mounting hole 5*a* formed in the riving knife 5. The riving knife 5 is clamped between the retainer sleeves 8. In this representative embodiment, the pivotal shaft 6 may be a bolt for example.

As shown in FIG. 3, the pivotal shaft 6 also pivotally supports the kickback-inhibiting members 10 via the respective sleeves 8. The kickback-inhibiting members 10 are positioned on opposite sides of the riving knife 5. A torsion coil spring 11 may be fitted on each sleeve 8 and have opposite ends engaged with the riving knife 5 and the corresponding kickback-inhibiting member 10. As a result, the kickback-inhibiting members 10 may be biased in such directions that the free ends of the kickback-inhibiting members 10 move downward (i.e., the counterclockwise direction as viewed in FIG. 2). As shown in FIG. 2, stopper pins 12 (only one stopper pin 12 is shown in FIG. 2) are mounted to the riving knife 5 and extend laterally outward from the riving knife 5 in order to limit the lower pivotal ends of the strokes of the kickback-inhibiting members 10.

Figure 5:
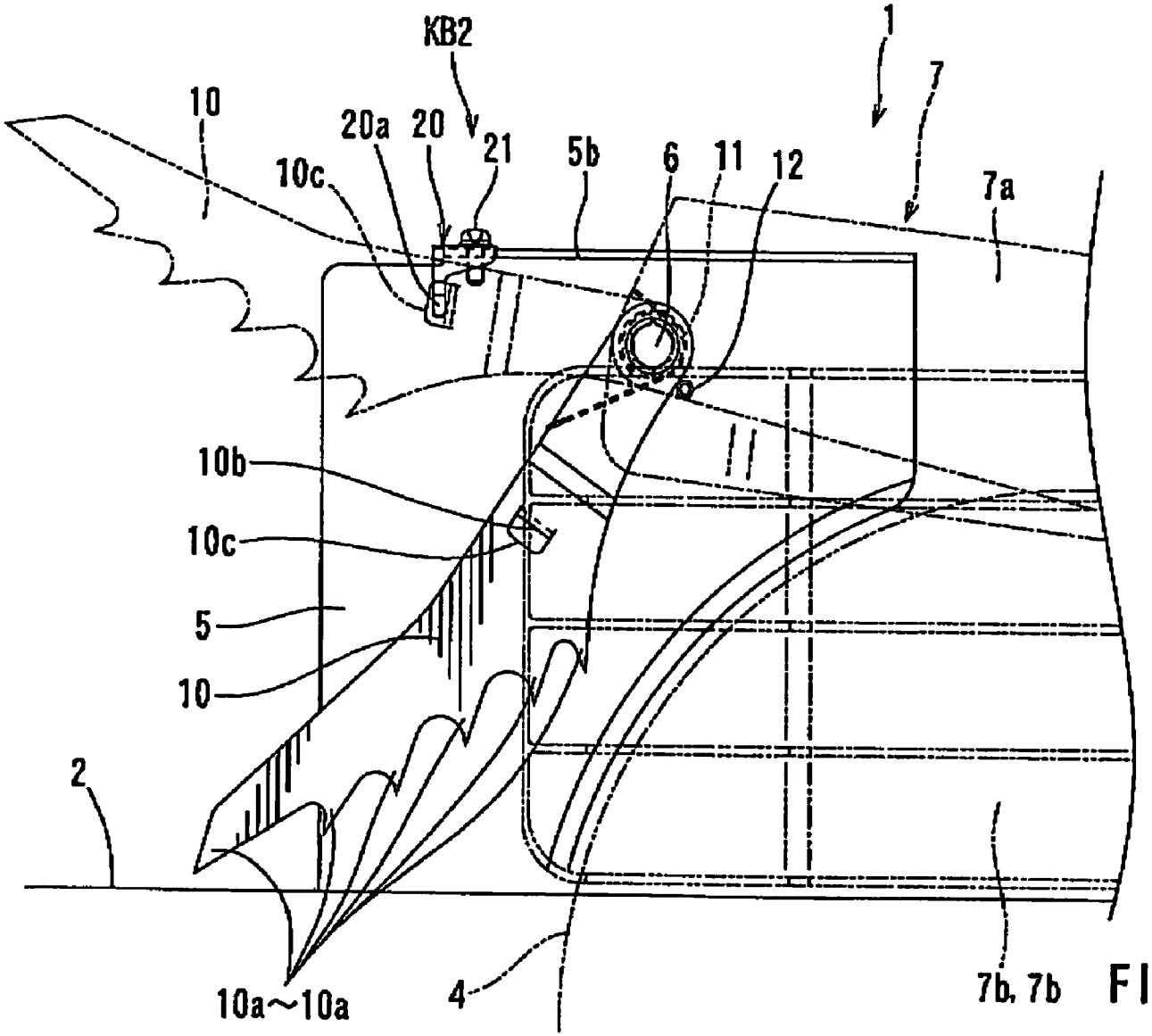
FIG. 5 is a side view of a kickback-inhibiting device according to a second representative embodiment.

As shown in FIG. 4, an upper potion 5*b* of the riving knife 5 is bent to have an L-shaped configuration. Consequently, the rigidity of the riving knife 5 is ensured with regard to a direction perpendicular surface of the riving knife 5. As shown in FIGS. 2 and 5, a plurality of claw portions 10*a* is formed on each of the kickback-inhibiting members 10 on the side directly opposing the workpiece W (i.e., the front side with respect to the cutting direction). The kickback-inhibiting members 10 are biased by the torsion coil springs 11 in such a direction that their free ends contact with the upper surface of the table 2. Therefore, the kickback-inhibiting members 10 are held in contact with the upper surface of the table 2 if there is no workpiece between the kickback-inhibiting members 10 and the upper surface of the table 2. After the front end of the workpiece W has been cut during a cutting operation, the front end of the workpiece W may contact the kickback-inhibiting members 10, pivoting the kickback-inhibiting members 10 upward against the biasing forces of the torsion coil springs 11. Therefore, the claw portions 10*a* of the kickback-inhibiting members 10 may be pressed against the upper surface of a portion of the workpiece W until the rear end of the workpiece W moves beyond the kickback-inhibiting members 10. Contact by the kickback-inhibiting members 10 continues for a period even after the workpiece W has been cut throughout its length. Therefore, the workpiece W may be reliably inhibited from being lifted up. In other words, the kickback phenomenon can be reliably inhibited.

Each of the kickback-inhibiting members 10 may have a wall portion 10*b* that slidably contacts with the corresponding side surface of the riving knife 5. Cutting and bending a part of the kickback-inhibiting member 10 forms the wall portion 10*b*. With this arrangement, each of the kickback-inhibiting members 10 may be held in a position appropriately spaced from the riving knife 5 by a predetermined distance via the wall portions 10*b*. Therefore, the kickback-inhibiting members 10 may be reliably prevented from intruding into the kerf of the workpiece W. Consequently, the claw portions 10*a* may reliably engage with predominantly the front end or the upper surface of the workpiece W. As a result, the kickback-inhibiting function can be readily exercised.

In addition, forming the wall portion 10*b* by cutting and bending the part of the kickback-inhibiting member 10 may result in the formation of a substantially rectangular, for example, retaining hole 10*c* in a central position with respect to the longitudinal direction of the kickback-inhibiting member 10. Claw retaining pins 13 may extend laterally from either side of the upper portion of the riving knife 5 for engagement with the respective retaining holes 10*c* of the kickback-inhibiting members 10. In this representative embodiment, a single spring pin is inserted into the riving knife 5 in the direction of the thickness such that opposite ends of the spring pin extend laterally from the riving knife 5 and may serve as the claw support pins 13.

In order to engage the claw retaining pins 13 and the respective retaining holes 10*c* with each other, the operator may first pivot the kickback-inhibiting members 10 against the biasing force of the torsion coil springs 11. The operator may then bring the respective retaining holes 10*c* into engagement with the claw retaining pins 13 by utilizing a possible tolerance of the support mechanism for supporting the kickback-inhibiting members 10 on the riving knife 5 and/or by slightly resiliently bending the kickback-inhibiting members 10 in the direction of their thickness. By engaging the retaining holes 10*c* with the claw retaining pins 13, the kickback-inhibiting members 10 may be held at the upwardly pivoted positions as indicated by the chain lines in FIG. 2 (herein also called the "inoperative positions"), so that the kickback-inhibiting members 10 are prevented from pivoting downward.

As described above, according to the representative kickback-inhibiting device KB1, it is possible to hold the kickback-inhibiting members 10 at the inoperative positions where the kickback-inhibiting members 10 do not contact with the workpiece W. Therefore, the claw portions 10*a* of the kickback-inhibiting members 10 may not cause damage to the surface of the workpiece W to be cut, even if the workpiece W is a decorative plywood panel or the like.

The kickback-inhibiting device KB1 may be modified in various ways. Possible modifications of the first representative embodiments will be hereinafter described as the second to sixth representative embodiments. In these embodiments, like members are given the same reference numerals as in the first representative embodiment and the description of these members may not be repeated.

Second Representative Embodiment

Figure 6:
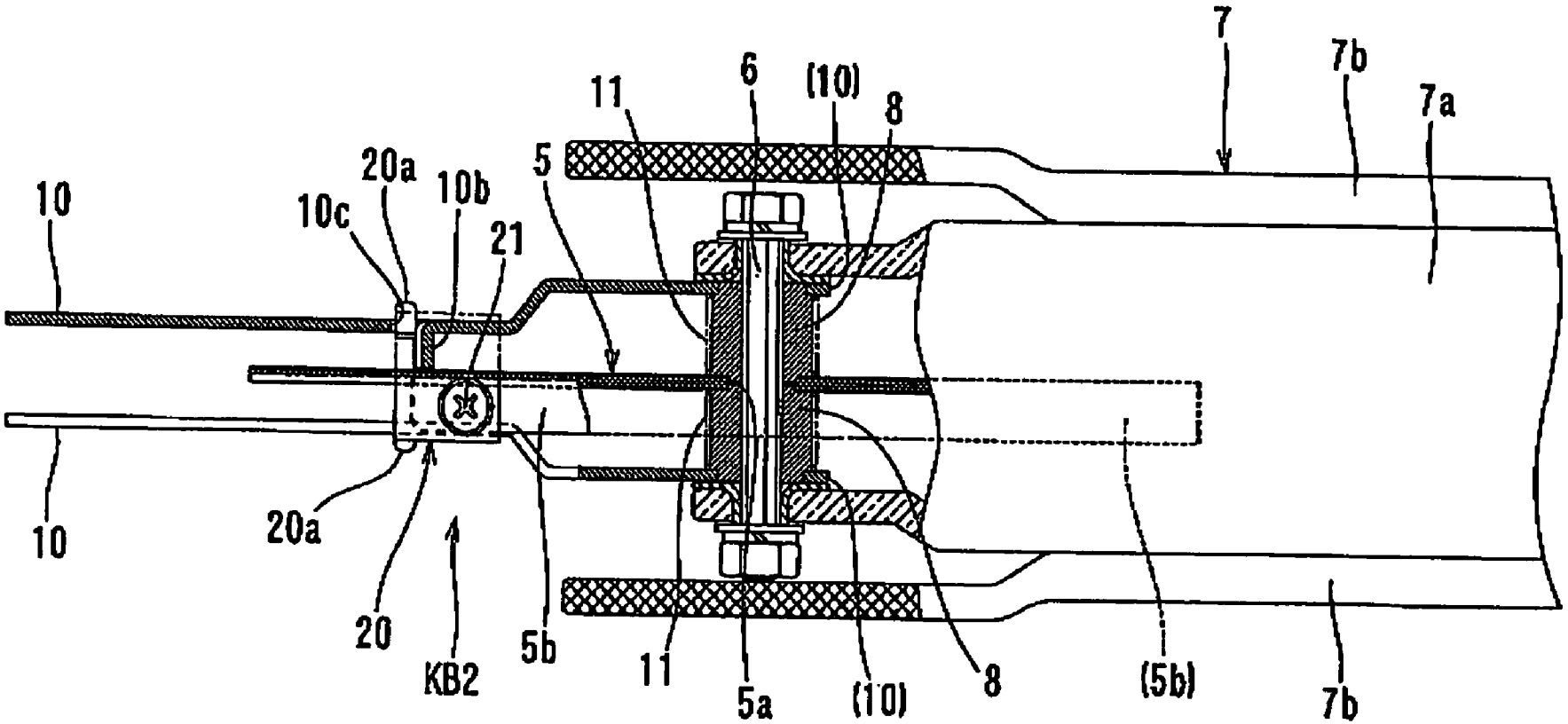
FIG. 6 is a top plan view of the kickback-inhibiting device of FIG. 5 with a portion shown in horizontal cross-section.
Figure 7:
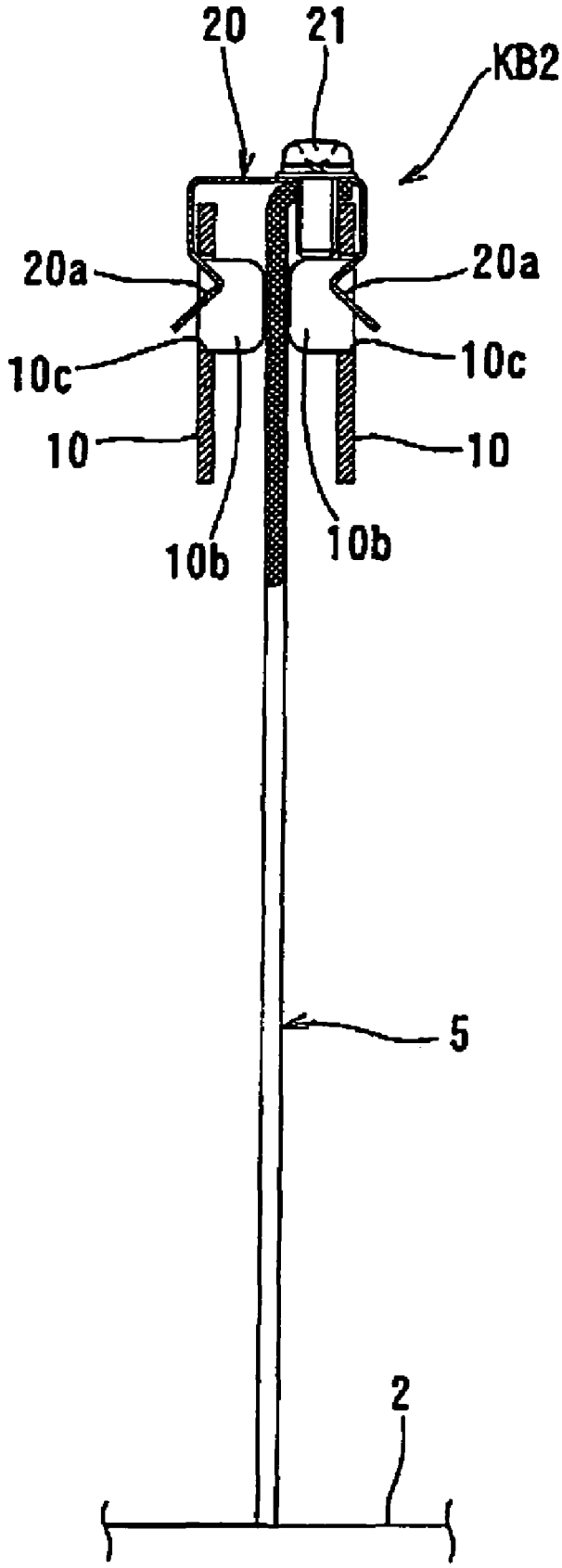
FIG. 7 is rear plan view with respect to the cutting direction, similar to FIG. 4, of the second embodiment of the kickback-inhibiting device in an inoperative position.

A second representative embodiment will now be described with reference to FIGS. 5 to 7. The second representative embodiment relates to a modification of the mechanism for holding the kickback-inhibiting members 10 in an inoperative position.

A second representative kickback-inhibiting device KB2 utilizes a leaf spring 20 in place of the claw retaining pins 13. The leaf spring 20 may be mounted to the upper bent portion 5*b* of the riving knife 5 by means of a screw 21. As shown in FIG. 7, the leaf spring 20 extends so as to straddle the upper bent portion 5*b*. The leaf spring 20 has opposite ends configured as engaging portions 20*a*, which are bent to have substantially V-shaped cross-sections. The engaging portions 20*a* are spaced the same distance away from opposite side surfaces of the riving knife 5.

Because the leaf spring 20 is incorporated in order to hold the kickback-inhibiting members 10, the operation for holding the kickback-inhibiting members 10 in the inoperative positions can be easily preformed. Thus, as the operator pivots the kickback-inhibiting members 10 upward against the biasing force of the torsion coil springs 11, the engaging portions 20*a* of the leaf spring 20 may automatically engage with the corresponding retaining holes 10*c* of the kickback-inhibiting members 10 due to the resilient force of the leaf spring 20. Consequently, the kickback-inhibiting members 10 may be resiliently held in the inoperative positions. The resilient forces or the retaining forces of the engaging portions 20*a* may be suitably determined such that the engaging portions 20*a* can hold the kickback-inhibiting members 10 in the inoperative positions against the biasing forces of the torsion coil spring 11.

In order to operate the kickback-inhibiting members 10 for inhibiting the kickback phenomenon, the operator may simply press the kickback-inhibiting members 10 downward to remove the engaging portions 20*a* from the retaining holes 20*c* against the biasing forces of the engaging portions 20*a*.

As described above, also with the second representative kickback-inhibiting device KB2, if necessary, the kickback-inhibiting members 10 can be held in the inoperative positions where the kickback-inhibiting members 10 do not contact with the workpiece W. Therefore, a cutting operation of a decorative plywood panel or the like can be made without causing damage to the panel.

Third Representative Embodiment

A third representative embodiment will now be described with reference to FIGS. 8 to 10, Referring to FIGS. 8 to 10, there is shown a third representative kickback-inhibiting device KB3. The third kickback-inhibiting device KB3 differs from the first and second representative kickback-inhibiting devices KB1 and KB2 in that the kickback-inhibiting members 10 may be pivoted between the operative positions and the inoperative positions by the pivotal operation of an operation lever 30, without the need for direct operation of the kickback-inhibiting members 10 as in the first and second representative kickback-inhibiting devices KB1 and KB2.

In the same manner as the kickback-inhibiting members 10 and the cover 7, the operation lever 30 is vertically pivotable about the pivotal shaft 6. Thus, the operation lever 30 has a pair of support plate portions 30*a*, each having a first end pivotally mounted to the pivotal shaft 6. The operation lever 30 also has an operation plate portion 30*b* connecting between second ends or free ends opposite to the first ends of the support plate portions 30*a*. As shown in FIG. 9, the pivotal shaft 6 pivotally supports the first ends of the support plate portions 30*a* while each first end may be slidably held between the corresponding kickback-inhibiting member 10 and the corresponding end part of the upper portion 7*a* of the cover 7.

Figure 8:
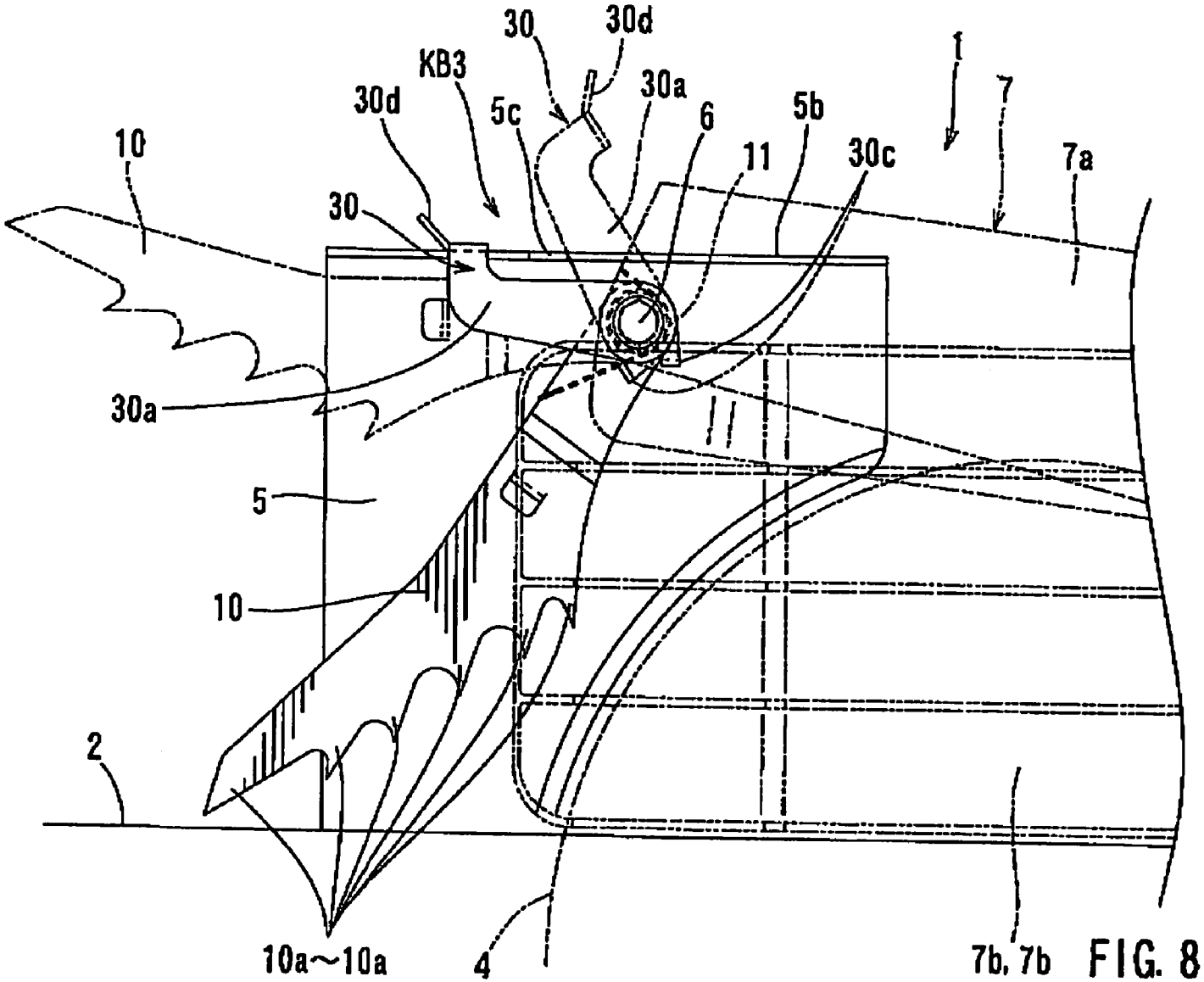
FIG. 8 is a side view of a kickback-inhibiting device according to a third representative embodiment.
Figure 9:
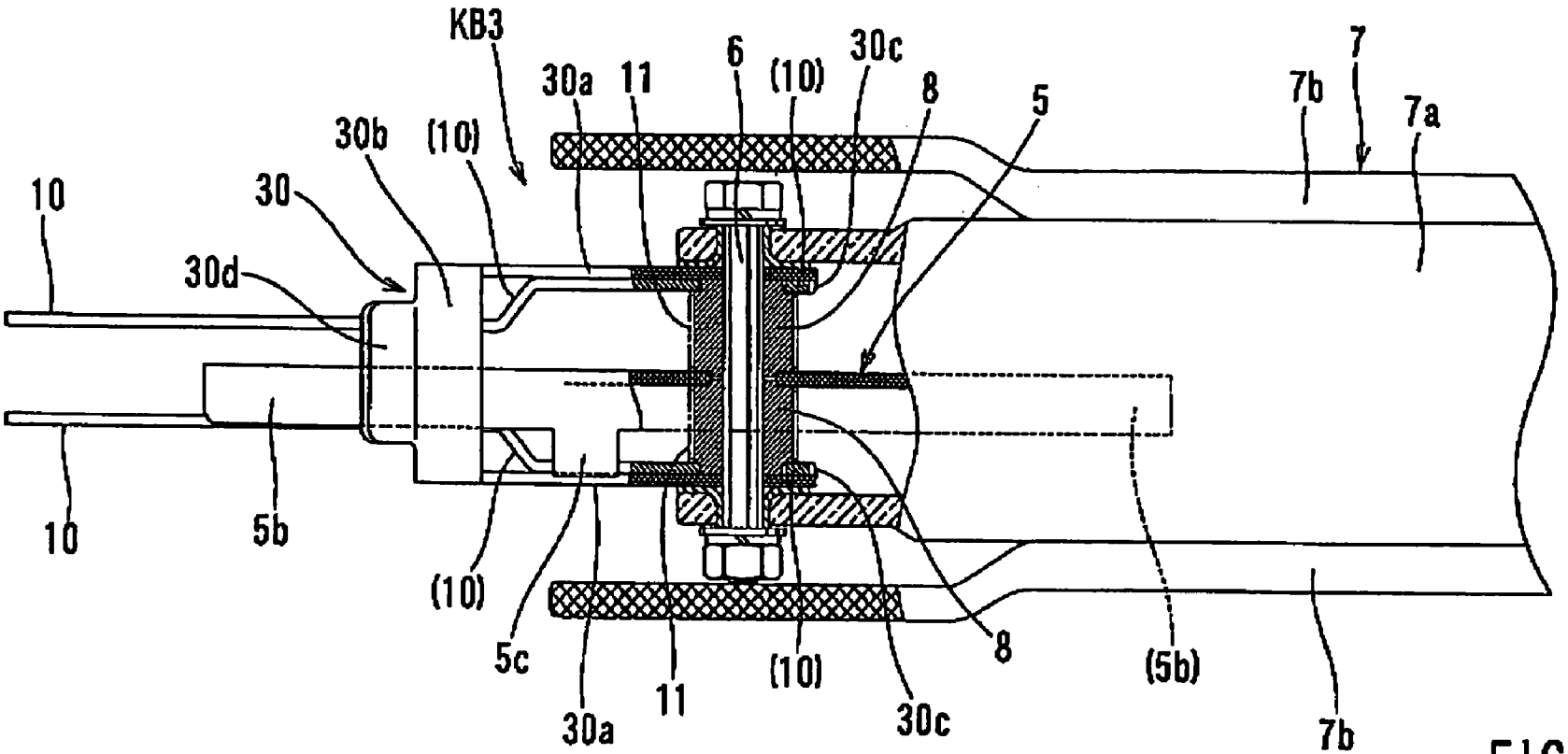
FIG. 9 is a top plan view of the kickback-inhibiting device of FIG. 8 with a portion shown in horizontal cross-section.
Figure 10:
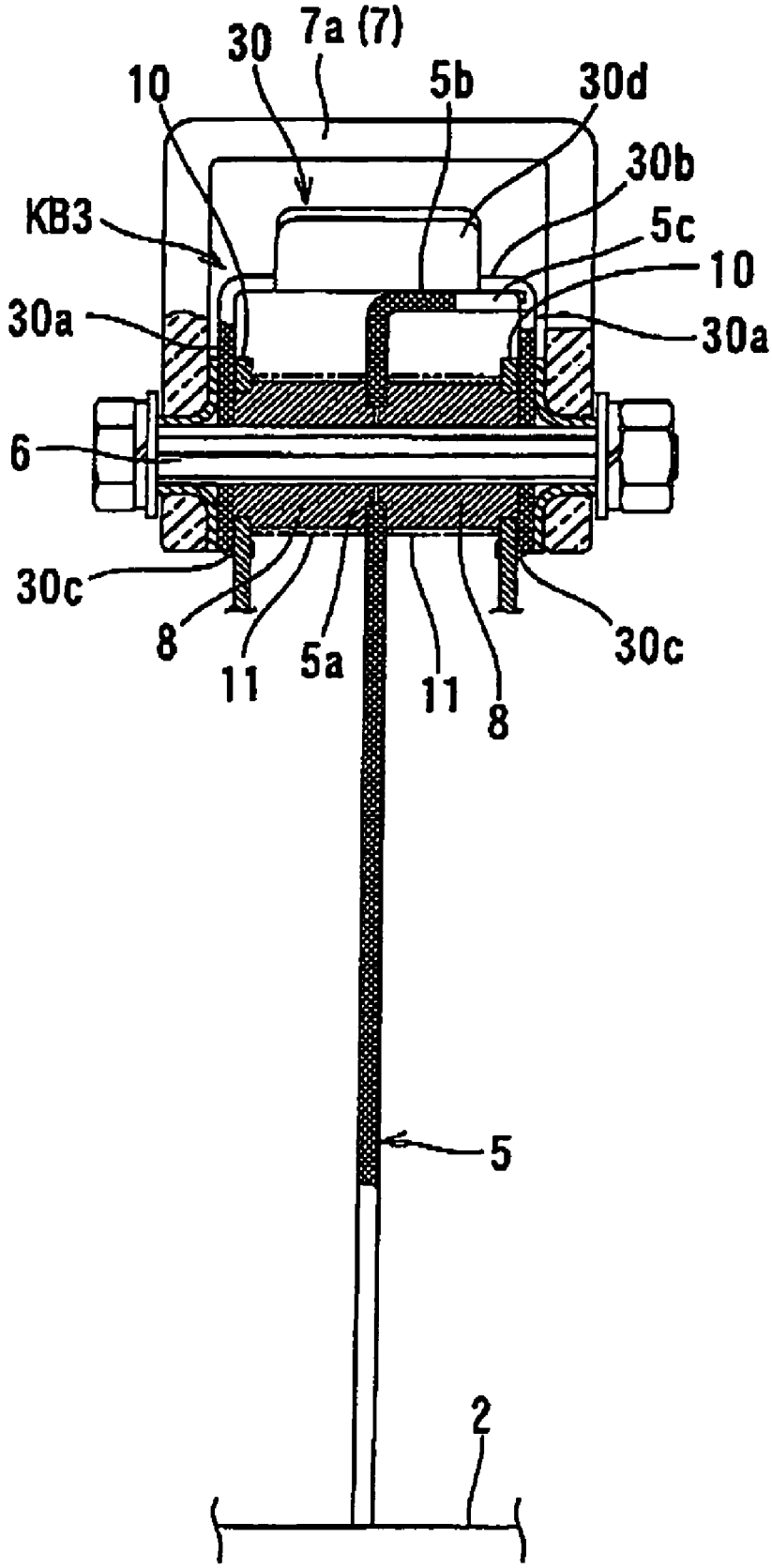
FIG. 10 is rear plan view with respect to the cutting direction, similar to FIG. 7, of the third embodiment of the kickback-inhibiting device in an operative position.

As shown in FIGS. 8 and 10, stopper portions 30*c* are formed on the first ends of the support plate portions 30*a* and extend toward each other for respectively engaging the lower sides (the sides in the clockwise direction as viewed in FIG. 8) of the kickback-inhibiting members 10. A knob 30*d* is formed on the central portion with respect to the width of the operation plate portion 30*b*.

A stopper edge 5*c* is formed on the upper bent portion 5*b* of the riving knife 5 to extend laterally from, and flush with, the upper bent portion 5*b*. The stopper edge 5*c* has a length within a predetermined range in the longitudinal direction (right and left directions as viewed in FIG. 8) of the upper bent portion 5*b*. As shown in FIG. 9, an end portion of the stopper edge 5*c* in the lateral direction is positioned above one of the support plate portions 30*a* of the operation lever 30.

According to the third representative kickback-inhibiting device KB3 described above, the operator can move the kickback-inhibiting members 10 from the operative position to the inoperative position so as to be held in the inoperative positions by the vertical pivotal operation of the operation lever 30. Thus, when the operation lever 30 has not been operated, the kickback-inhibiting members 10 may be positioned at the operative positions through the biasing force of the torsion coil springs 11, so that the claws 10*a* of the kickback-inhibiting members 10 may engage the upper surface of the workpiece W for inhibiting the kickback phenomenon. In addition, the operation lever 30 may be biased in the counterclockwise direction as viewed in FIG. 8 due to the contact of the kickback-inhibiting members 10 with the stopper portions 30*c* of the support plate portions 30*a*. The kickback-inhibiting members 10 are biased in the counterclockwise direction by the torsion coil springs 11. As a result, the operation lever 30 may be held in a position indicated by the solid lines in FIG. 8, in which the operation plate portion 30*b* is resting on the upper bent portion 5*b* of the riving knife 5.

In order to move the kickback-inhibiting members 10 from the operative positions to the inoperative positions indicated by the chain lines in FIG. 8, the operator may grip the knob 30*d* of the operation lever 30 and pivot the operation lever 30 upward. Because the stopper portions 30*c* of the operation lever 30 are in contact with the lower sides of the respective kickback-inhibiting members 10, the kickback-inhibiting members 10 may pivot upward against the biasing forces of the torsion coil springs 11 along with the upward pivotal movement of the operation lever 30.

During the upward pivotal movement of the operation lever 30, one of the support plate potions 30*a* of the operation lever 30, the one that vertically opposes the stopper edge 5*c* of the riving knife 5 for example, may move upward beyond the stopper edge 5*c*. This occurs by the resilient deformation that may be caused when the upper edge of the one of the support plate portions 30*a* contacts with the stopper edge 5*c*, or this may be caused prior to the support plate portions 30*a* contacting with the stopper edge 5*c* by the manual operation of the operator. After one of the support plate portions 30*a* of the operation lever has moved upward beyond the stopper edge 5*c*, the operator may release the operation lever 30 so that the one of the support plate portions 30*a* may contact with the upper side of the stopper edge 5*c*. As a result, the operation lever 30 may be held in the position indicated by the chain lines in FIG. 8. When the operation lever 30 is in this position, the kickback-inhibiting members 10 may be held in the operative positions indicated by the chain lines in FIG. 8, where the kickback-inhibiting members 10 may not contact the workpiece W.

In order to return the kickback-inhibiting members 10 from the inoperative positions to the operative positions, the operator may press the operation lever 30 downward to cause the resilient deformation of the one of the support plate portions 30*a* due to contact with the stopper edge 5*c*, or the operator may manually resiliently deform the one of the support plate portions 30*a* prior to contact with the stopper edge 5*c*. Consequently, the one of the support plate portions 30*a* may move downward beyond the stopper edge 5*c*. After the one of the stopper plate portions 30*a* has moved downward beyond the stopper edge 5*c*, the operator may release the operation lever 30, so that the operation lever 30 may automatically move to the position indicated by the solid lines in FIG. 8. Thus, the biasing force of the torsion coil springs 11 is always applied to the operation lever 30 via the stopper portions 30*c* contacting with the biased kickback-inhibiting members 10. Therefore, the operation lever 30 may be pivoted downward together with the kickback-inhibiting members 10 by the biasing force of the torsion coil springs 11. As a result, the kickback-inhibiting members 10 may return to the operative positions for contacting with the upper surface of the workpiece W, while the operation plate portion 30*b* may be brought to contact the upper edge of the upper bent portion 5*b* of the riving knife 5, so that the operation lever 30 may be held in a position indicated by the solid lines in FIG. 8.

As described above, according to the third representative kickback-inhibiting device KB3, the kickback-inhibiting members 10 may be moved from the operative positions to the inoperative positions or vice versa by the pivotal operation of the operation lever 30. An operator may perform this operation while he or she grips the knob 30*d* of the operation lever 30. The operator does not need to pivot the kickback-inhibiting members 10 by directly gripping the kickback-inhibiting members 10. In addition, the operator only needs to operate a single operation lever 30. Therefore, the third representative kickback-inhibiting device KB3 is improved in operability.

Fourth Representative Embodiment

Figure 11:
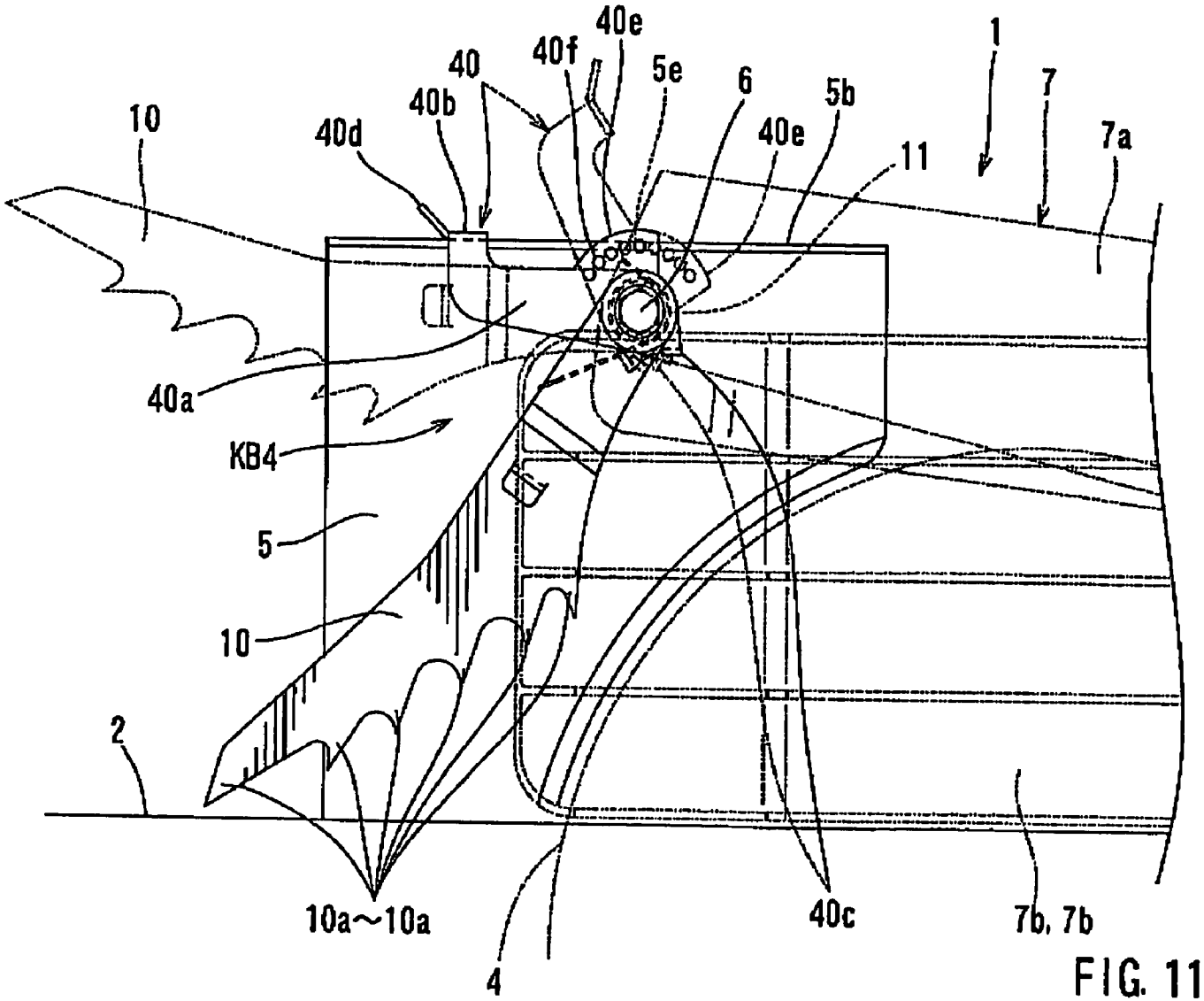
FIG. 11 is a side view of a kickback-inhibiting device according to a fourth representative embodiment.
Figure 12:
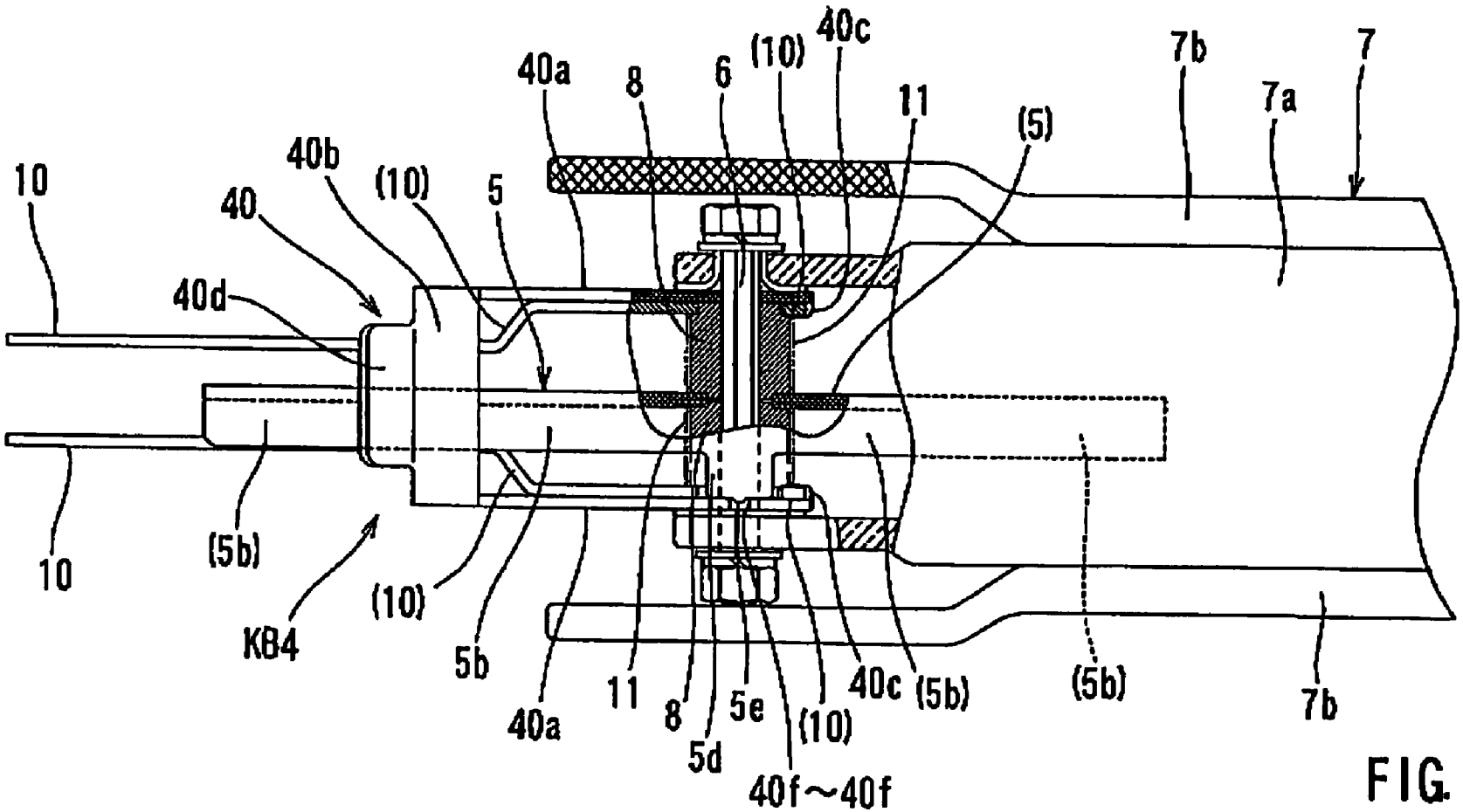
FIG. 12 is a top plan view of the kickback-inhibiting device of FIG. 11 with a portion shown in horizontal cross-section.
Figure 13:
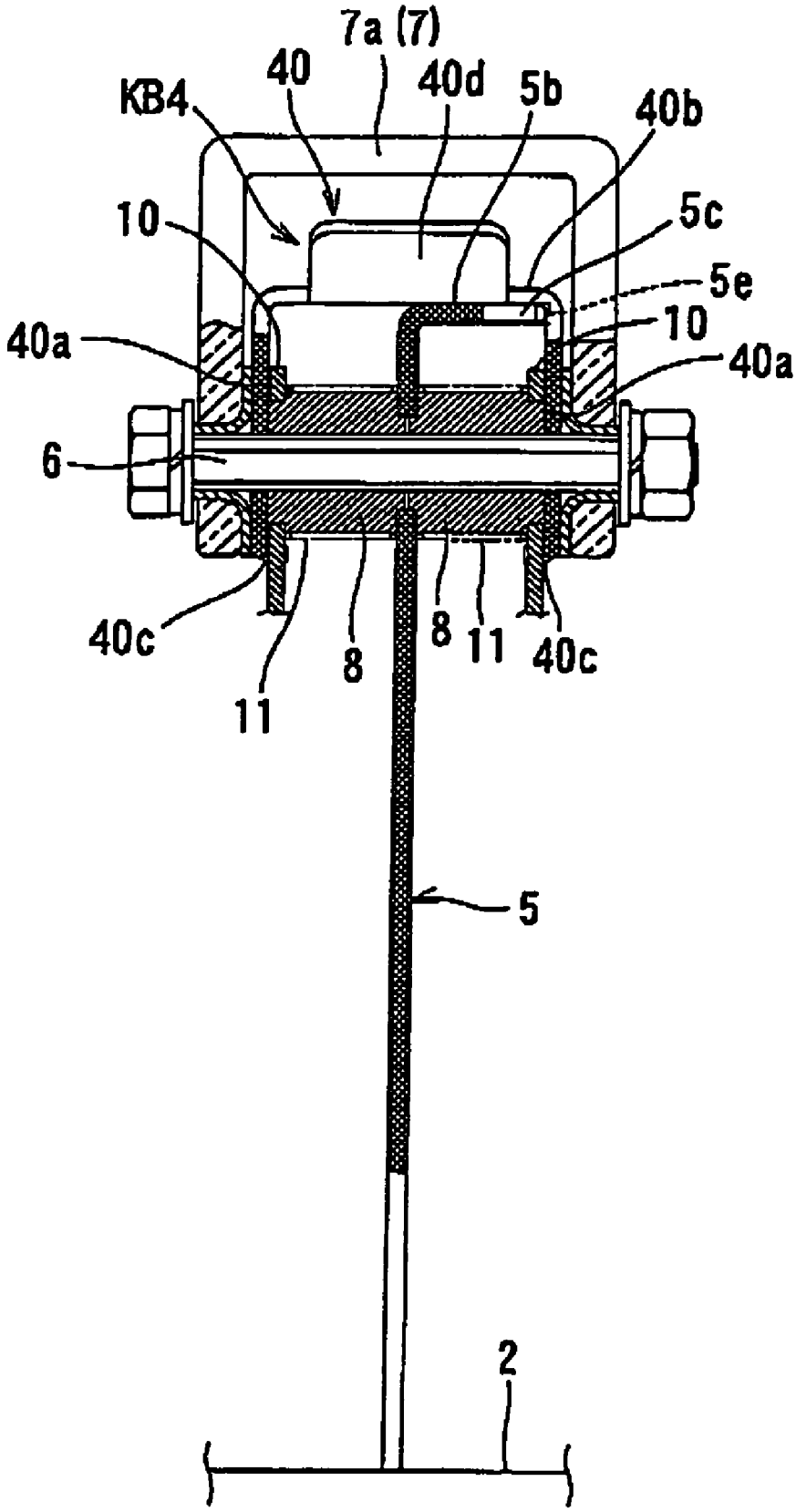
FIG. 13 is rear plan view with respect to the cutting direction, similar to FIG. 10, of the fourth embodiment of the kickback-inhibiting device in an operative position.

A fourth representative embodiment will now described with reference to FIGS. 11 to 13. In FIGS. 11 to 13, a fourth representative kickback-inhibiting device KB4 is shown that is a modification of the third representative kickback-inhibiting device KB3. Therefore, in FIGS. 11 to 13, like members are given the same reference numerals as in the third representative embodiment.

The fourth representative kickback-inhibiting device KB4 has an operation lever 40 that corresponds to the operation lever 30 but differs from the operation lever 30 in that the operation lever 40 can be selectively and releasably fixed in a variety of inoperative positions. Similar to the operation lever 30, the operation lever 40 has a pair of support plate portions 40*a*, each having a first end pivotally mounted to the pivotal shaft 6. In addition, the operation lever 40 also has an operation plate portion 40*b* connecting between the second ends or free ends opposite to the first ends of the support plate portions 40*a*. A knob 40*d* is formed on the operation plate portion 40*b*.

As shown in FIG. 11, each of the first ends of the support plate portions 40*a* has a stopper portion 40*c*. The stopper portion 40*c* of each support plate portion 40*a* is positioned to oppose a lower side (the first side in the clockwise direction as viewed in FIG. 11) of the corresponding kickback-inhibiting member 10 for engaging with the lower side. A retainer plate portion 40*e* is formed on the first end of one of the support plate portions 40*a*. The retainer plate portion 40*e* may have a sectorial configuration. The retainer plate portion 40*e* may have a plurality of engaging recesses 40*f* arranged along the circumferential direction of the retainer plate portion 40*e*. More specifically, the engaging recess 40*f* are arranged along an arc with respect to the pivotal shaft 6.

As shown in FIGS. 12 and 13, a wall portion 5*d* is formed on the upper bent portion 5*b* of the riving knife 5 and extends flush with the upper bent portion 5*b*. An engaging projection 5*e* is formed on the extended end of the wall portion 5*d* and is positioned to oppose the retainer plate portion 40*e* so as to be able to engage with one of the engaging recesses 40*f*.

Therefore, as the operation lever 40 is pivoted, the engaging projection 5*e* may selectively engage with one of the engaging recesses 40*f* so that the operation lever 40 can be held in position relative to the riving knife 5. As a result, the operation lever 40 can be selectively positioned at a desired pivoted orientation from among the positions corresponding to the engaging recesses 40*f*. The engagement of the engaging projection 5*e* with the engaging recesses 40*f* and removal of the engaging projection 5*e* from the engaging recesses 40*f* may be performed by utilizing the resilient deformation of the support plate portion 40*a* of the operation lever 40.

In this way, in addition to the same operations and advantages as in the third representative kickback-inhibiting device KB3, the fourth representative kickback-inhibiting device KB4 enables the operation lever 40 to be held in any one of a plurality of pivoted positions determined by the engaging recesses 40*f*. As a result, the upward resting position of the kickback-inhibiting members 10 can be selectively determined from among a plurality of upward resting positions or the inoperative positions.

Therefore, the kickback-inhibiting members 10 may be moved to the resting position from the operative positions by a minimum distance in response to the thickness of the workpiece W, without having to be moved by a more than necessary distance. The kickback-inhibiting members can then be rapidly moved from the operative positions to the inoperative positions or vice versa.

Fifth Representative Embodiment

A fifth representative embodiment will now be described with reference to FIGS. 14 to 20. In FIGS. 14 to 20, there is shown a fourth representative kickback-inhibiting device KB5 that is a modification of the third representative kickback-inhibiting device KB3. Therefore, in FIGS. 14 to 20, like members are given the same reference numerals as in the third representative embodiment.

The fifth representative kickback-inhibiting device KB5 has an operation lever 50 in place of the operation lever 30 of the third representative embodiment. The operation lever 50 has an upper portion 50*a* and left and right portions 50*b* and 50*c*. The operation lever 50 has a substantially inverted U-shaped cross-section straddling the upper bent portion 5*b* of the riving knife 5. The operation lever 50 is slidably movable along the upper bent portion 5*b* of the riving knife 5 in the longitudinal direction of the upper bent portion 5*b*. The operation lever 50 has a guide hole 50*d* elongated in the longitudinal direction of the upper bent portion 5*b*. The left and right side portions 50*b* and 50*c* respectively have rear ends, which extend in the cutting direction beyond the rear end of the upper portion 50*a*.

An intermediate lever 51 is disposed inside of the operation lever 50 and is also configured to straddle the upper bent portion 5*b* of the riving knife 5. The intermediate lever 51 has an upper portion 51*a* and left and right side portions 51*b* and 51*c*. The upper portion 51*a* is positioned between the upper portion 50*a* of the operation lever 50 and the upper bent portion 5*b* of the riving knife 5. The left and right side portions 51*b* and 51*c* respectively extend downward from the left and right edges of the upper portion 51*a* and along opposite sides of the riving knife 5. The intermediate lever 51 also has a guide hole 51*d* elongated along the longitudinal direction of the upper bent portion 5*b* of the riving knife 5.

The guide hole 50*d* of the operation lever 50 is positioned to align with the guide hole 51*d* of the intermediate lever 51. A guide screw 52 is inserted into and through the guide holes 50*d* and 51*d* and is engaged with a corresponding threaded hole formed in the upper bent portion 5*b* so that the operation lever 50 and the intermediate lever 51 can slide along the upper bent portion 5*b* of the riving knife independently of each other.

Engaging arms 51*e* and 51*f* are respectively formed on the lower ends of the side portions 51*b* and 51*c* of the intermediate lever 51 and extend to the front and laterally from the lower ends of the side portions 51*b* and 51*c*. Therefore, the engaging arms 51*e* and 51*f* respectively have L-shaped configurations in a top plan view. Engaging arms 51*e* and 51*f* have extended ends that are positioned below the lower sides of the first ends of the kickback-inhibiting members 10 on the front side with respect to the cutting direction. The extended ends engage the kickback-inhibiting members 10 in a clockwise direction as viewed in FIG. 14.

Therefore, when the intermediate lever 51 is slidingly moved to the rear with respect to the cutting direction (i.e., leftward as viewed in FIG. 14) along the upper bent portion 5*b* of the riving knife 5, the engaging arms 51*e* and 51*f* engage with the lower edges of the respective kickback-inhibiting members 10 and pivot the kickback-inhibiting members 10 from operative positions to inoperative positions in a clockwise direction about the pivotal shaft 6. Because the kickback-inhibiting members 10 are biased toward the operative positions by the torsion coil springs 11, the intermediate lever 51 may be slidingly moved in a cutting direction against the biasing force of the torsion coil springs 11. In other words, the intermediate lever 51 may be biased to the front with respect to the cutting direction (i.e., the right direction as viewed in FIG. 14).

The intermediate lever 51 may be slidably moved as the operator slidably moves the operation lever 50. To this end, engaging projections 50*e* and 50*f* are respectively formed on the rear end and the front end, as viewed in the cutting direction, of the operation lever 50 and are bent downward toward the intermediate lever 51. As the operator moves the operation lever 50 so as to slide the lever 50 to the rear (i.e., in a cutting direction), the engaging projection 50*f* may engage the front end of the intermediate lever 51. As the operation lever 50 is further moved in a cutting direction, the intermediate lever 51 may be slidably moved in the same direction together with the operation lever 50. Consequently, the kickback-inhibiting members 10 may be pivoted from operative positions toward the inoperative positions against the biasing force of the torsion coil springs 11.

Figure 14:
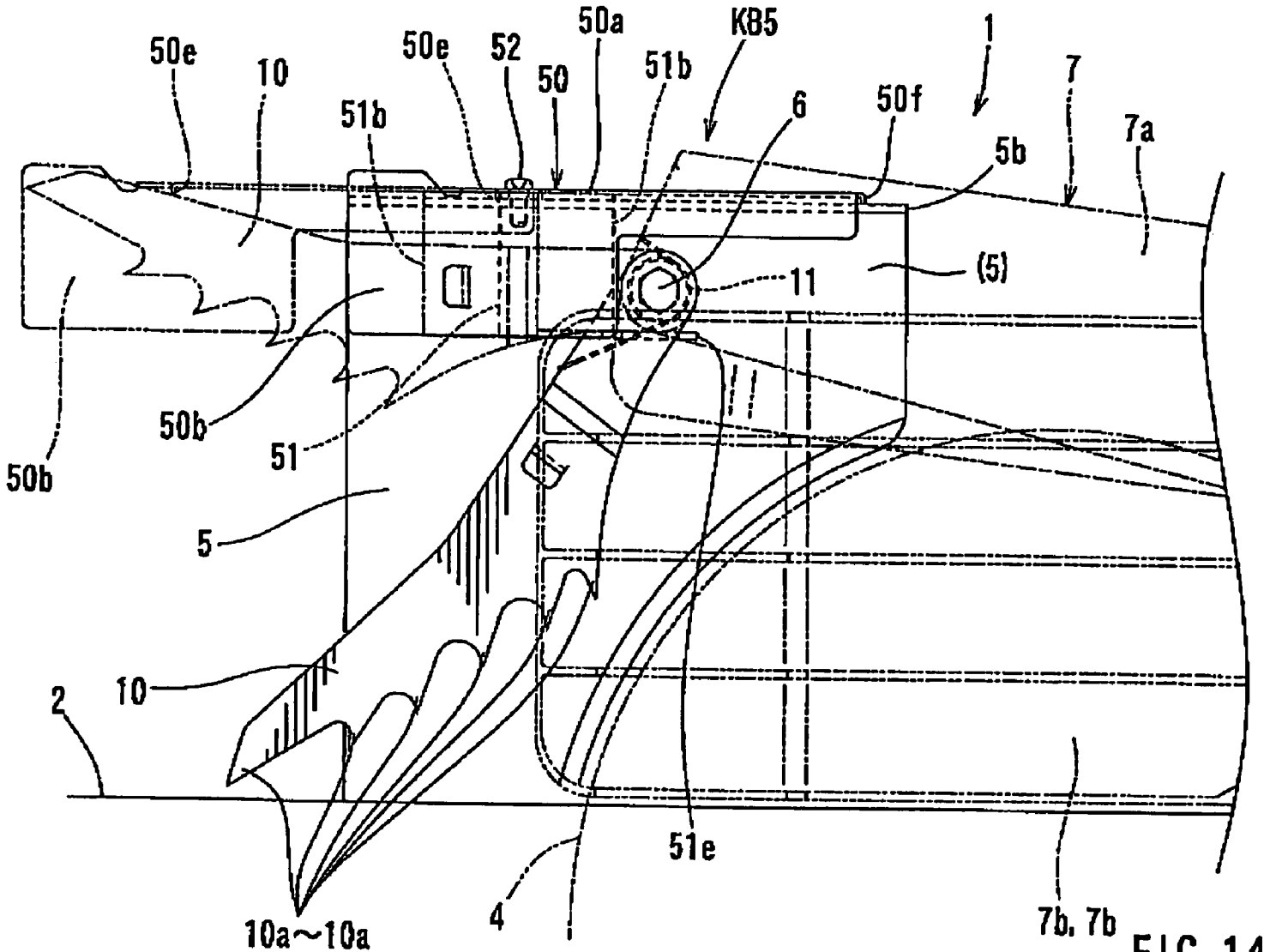
FIG. 14 is a side view of a kickback-inhibiting device according to a fifth representative embodiment.
Figure 15:
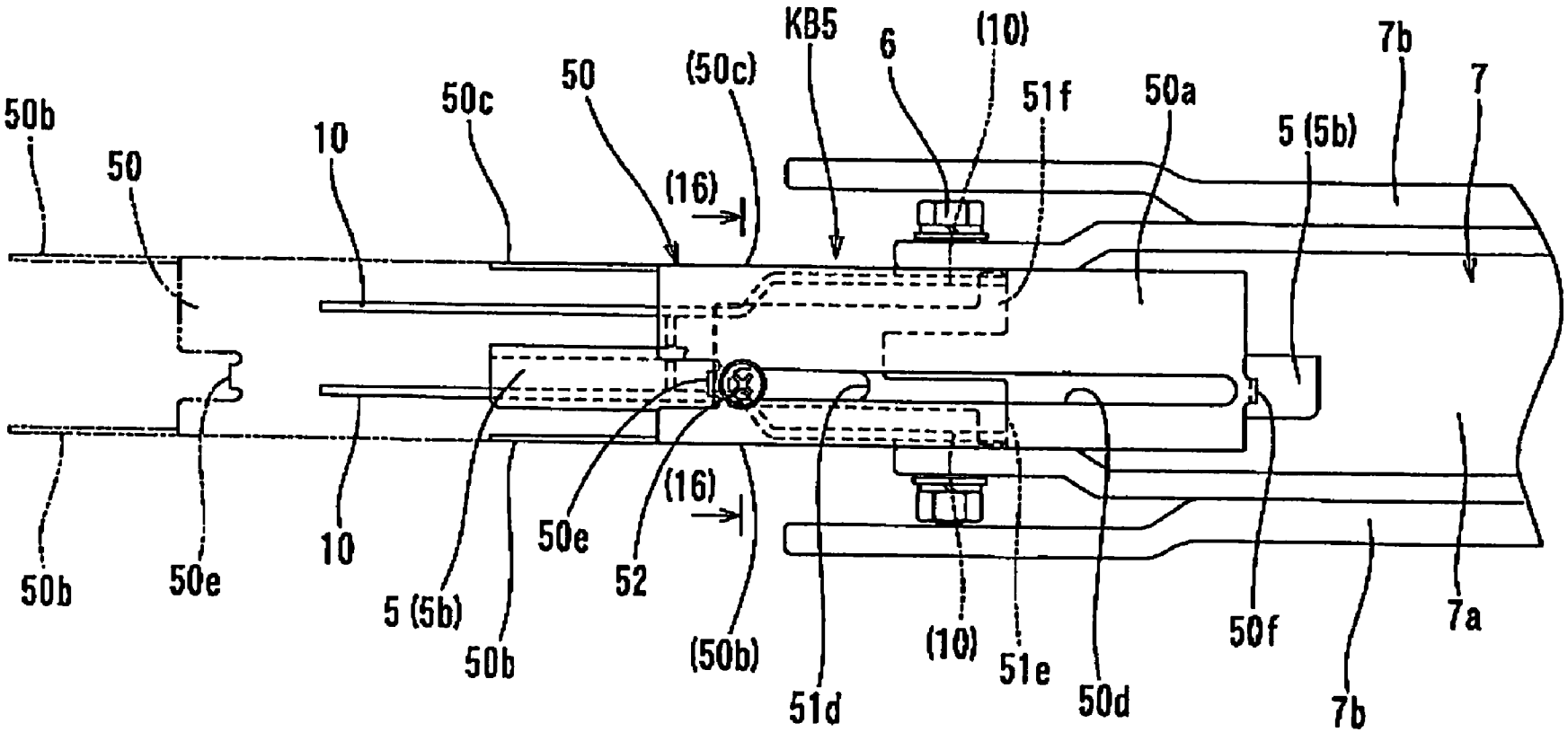
FIG. 15 is a top plan view of the kickback-inhibiting device of FIG. 14 with a portion shown in horizontal cross-section.
Figure 16:
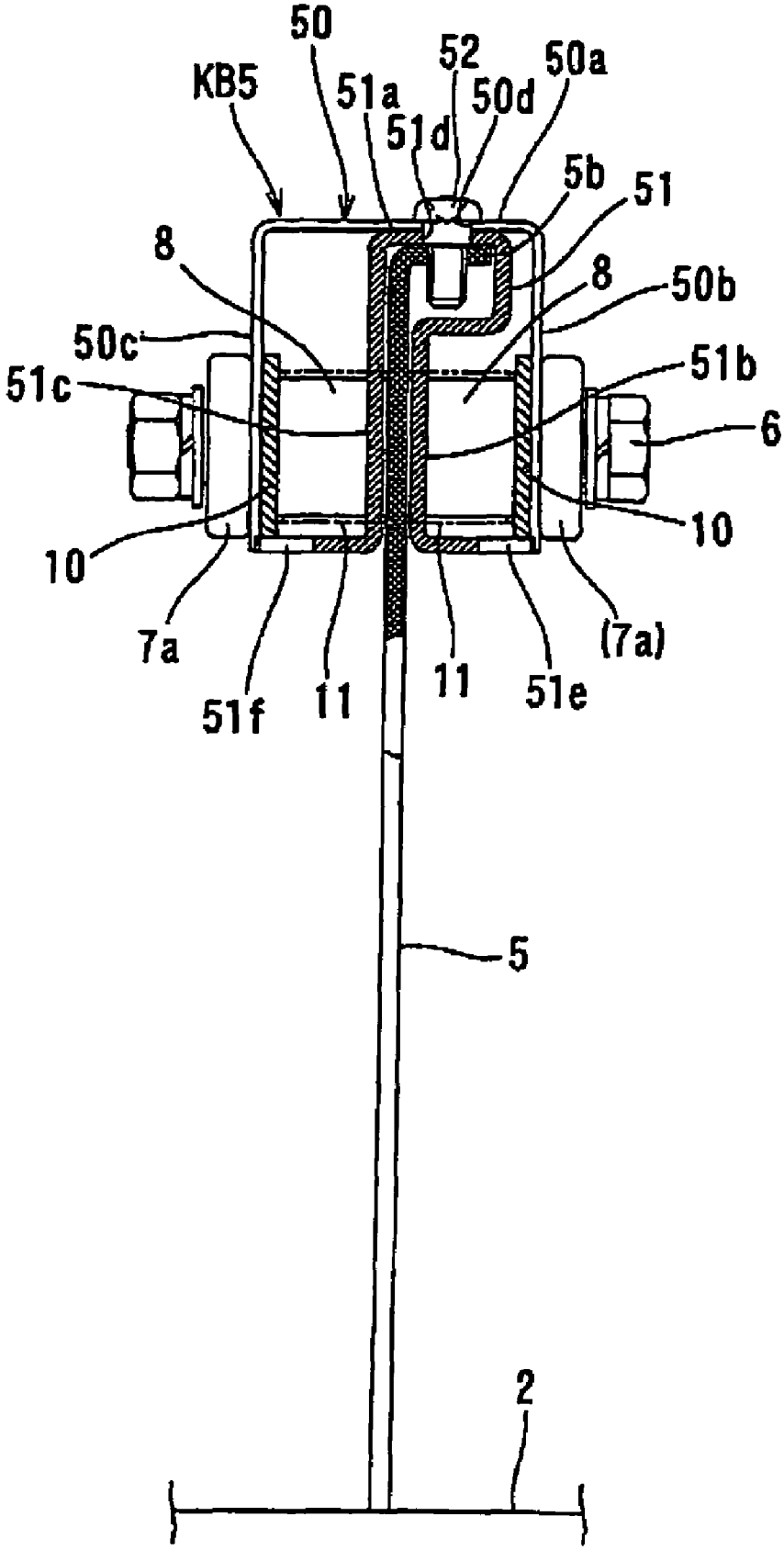
FIG. 16 is rear plan view with respect to the cutting direction, similar to FIG. 13, of the fifth embodiment of the kickback-inhibiting device in an inoperative position.

When the operation lever 50 as well as the intermediate lever 51 has been moved to the rearward most position, the kickback-inhibiting members 10 may be positioned at the inoperative positions and may be held in these positions as indicated by the chain lines in FIG. 14.

When the kickback-inhibiting members 10 are positioned in the inoperative positions, the kickback-inhibiting members 10 may enter the space between the side portions 50*b* and 50*c* of the operation lever 50. As a result, it is possible to inhibit or prevent any unintentional interaction between the kickback-inhibiting members 10 and other parts or articles. In this way, the operation lever 50, in particular its side portions 50*b* and 50*c*, may serve as a cover for shielding the kickback-inhibiting members 10.

The kickback-inhibiting members 10 may return to the operative positions when the operator moves the operation lever 50 to the front as viewed in the cutting direction (rightward as viewed in FIG. 14). Thus, as the operation lever 50 moves to the front, the engaging projection 50*e* at the rear end of the operation lever 50 may engage the rear end of the intermediate lever 51. While the intermediate lever 51 is engaged by the engaging projection 50*e*, the intermediate lever 51 may be forced to move together with the operation lever 50. Therefore, the intermediate lever 51 may be reliably moved to the front as the operation lever 50 is moved to the front, so that the kickback-inhibiting members 10 may be reliably returned to the operative positions due to the biasing forces of the torsion coil springs 11. In addition, the intermediate lever 51 may also be moved to the front together with the operation lever 50 due to biasing forces, because the intermediate lever 51 is indirectly biased to the front by the biasing forces of the torsion coil springs 11 applied to the kickback-inhibiting members 10.

The movement of the operation lever 50 and the intermediate lever 51 relative to the riving knife 5 in response to the sliding operation of the operation lever 50 will be described more in detail with reference to FIGS. 17 to 20. For the purpose of illustration, the kickback-inhibiting members 10 are eliminated in FIGS. 17 to 20. In addition, the cutting direction is to the left as viewed in FIGS. 17(*a*) and 17(*b*) to 20(*a*) and 20(*b*).

Figure 17:
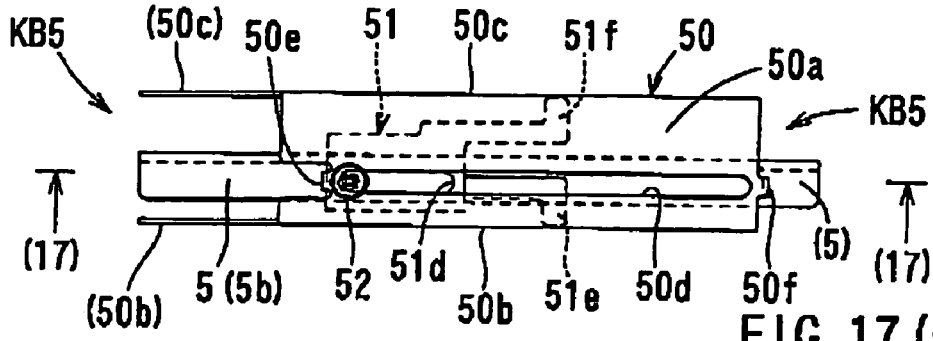
FIGS. 17(*a*) and 17(*b*) are a top plan view and a side view of a portion of the representative kickback-inhibiting device and showing the operation of an operation lever and an intermediate lever kickback-inhibiting members are positioned in operative positions.
Figure 17:
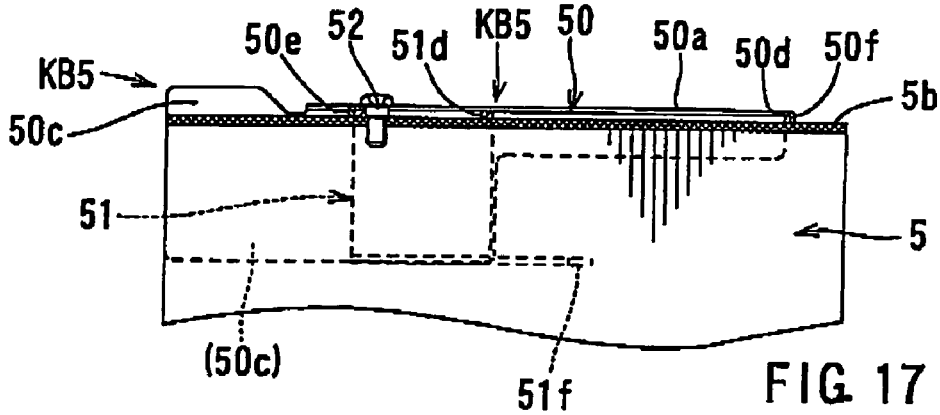

FIGS. 17(*a*) and 17(*b*) show an initial state where the operation lever 50 has not yet been moved by sliding. This condition corresponds to the condition indicated by the solid lines in FIG. 14 where the kickback-inhibiting members 10 are positioned at the operative positions.

Figure 18:
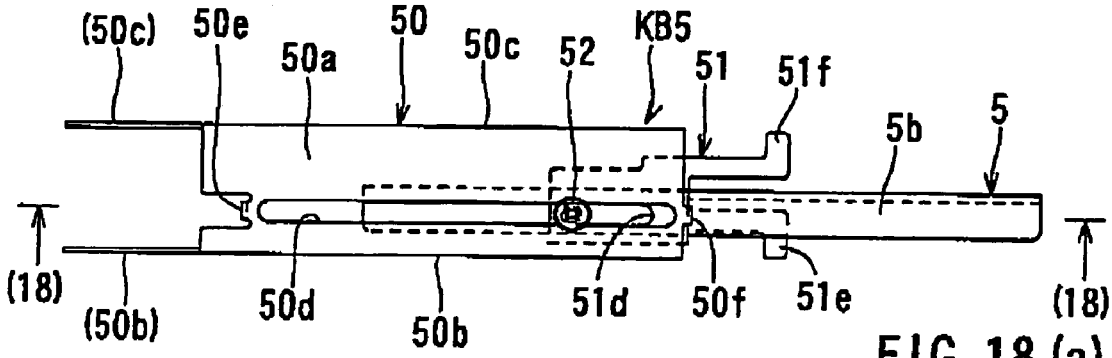
FIGS. 18(*a*) and 18(*b*) are a top plan view and a side view similar to FIGS. 17(*a*) and 17(*b*) but showing the operation where the operation lever has been independently slidably moved rearward in the cutting direction.
Figure 18:
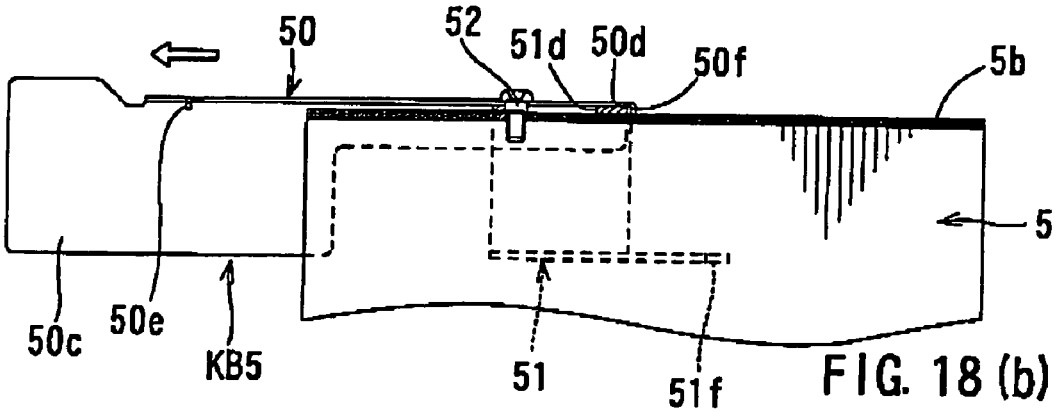

As the operation lever 50 is slidingly moved in the cutting direction from the position shown in FIGS. 17(*a*) and 17(*b*), the engaging projection 50*f* at the front end of the operation lever 50 may engage the front end of the intermediate lever 51 as shown in FIGS. 18(*a*) and 18(*b*). The intermediate lever 51 may move in the cutting direction together with the operation lever 50. As the intermediate lever 51 moves rearward, the engaging arms 51*e* and 51*f* may move rearward and respectively engage the kickback-inhibiting members 10, pivoting the kickback-inhibiting members 10 upward.

Figure 19:
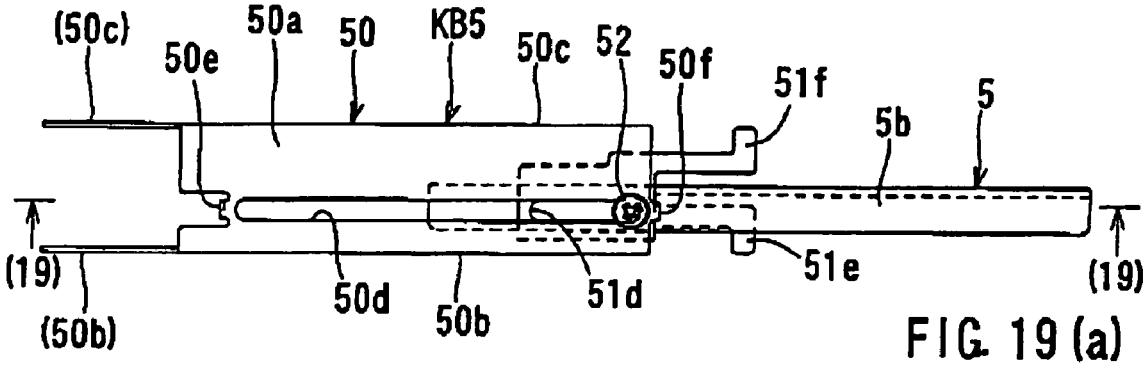
FIGS. 19(*a*) and 19(*b*) are a top plan view and a side view similar to FIGS. 17(*a*) and 17(*b*) but showing the operation where the operation lever and the intermediate lever have been slidably moved rearward in the cutting direction and where the kickback-inhibiting members are held in inoperative positions.
Figure 19:
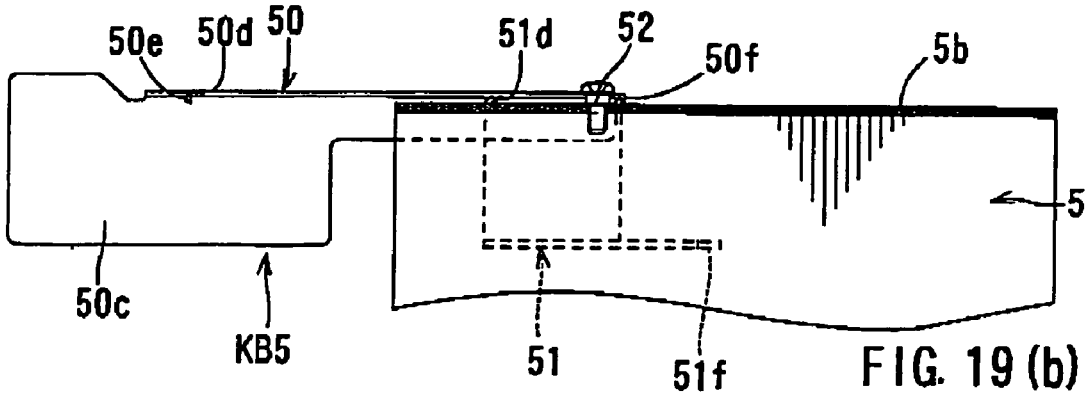

When the operation lever 50 and the intermediate lever 51 have moved to their rearward stroke ends shown in FIGS. 19(*a*) and 19(*b*), the kickback-inhibiting members 10 have reached the uppermost positions or the inoperative positions and may be held in these positions as indicated by the chain lines in FIG. 14. As described previously, in the inoperative positions the kickback-inhibiting members 10 may enter the space between the side portions 50*b* and 50*c* of the operation lever 50 so as to be covered by the operation lever 50.

With the kickback-inhibiting members 10 held in the inoperative positions, a cutting operation may be performed without causing any contact between the kickback-inhibiting members 10 and the workpiece W. Therefore, the kickback-inhibiting members 10 may not damage a decorative plywood panel or the like.

Figure 20:
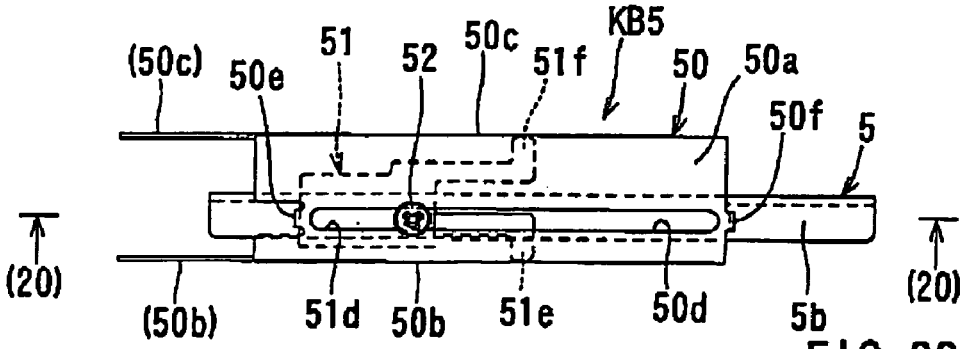
FIGS. 20(*a*) and 20(*b*) are a top plan view and a side view similar to FIGS. 17(*a*) and 17(*b*) but showing the operation where the operation lever has been independently moved forwardly, opposite to the cutting direction, from the state shown in FIGS. 19(*a*) and 19(*b*).
Figure 20:
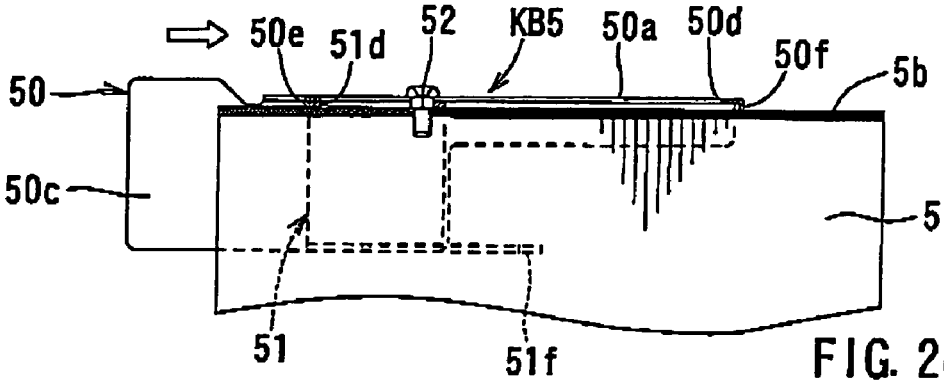
Figure 21:
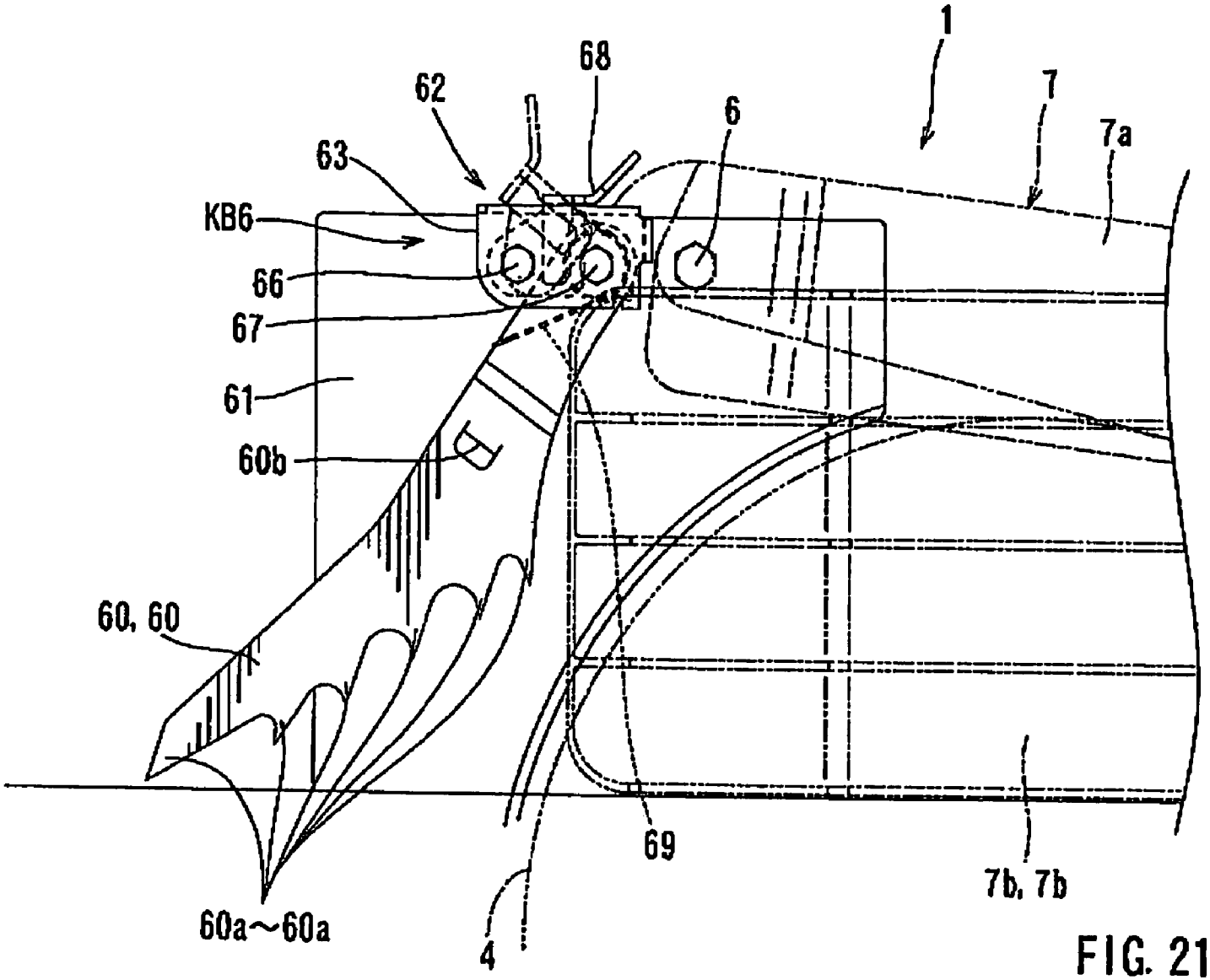
FIG. 21 is a side view of a kickback-inhibiting device according to a sixth representative embodiment.
Figure 22:
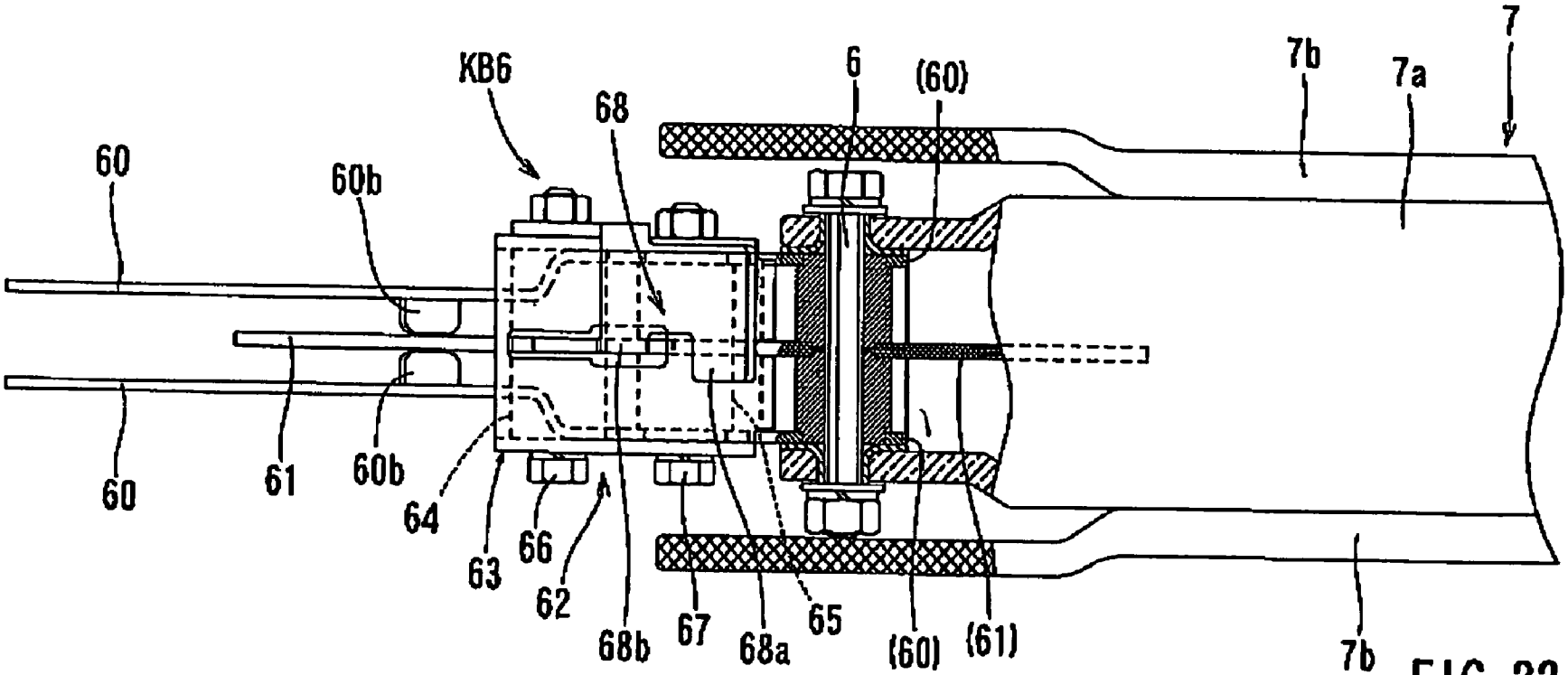
FIG. 22 is a top plan view of the kickback-inhibiting device of FIG. 21 with a portion shown in horizontal cross-section.

In order to return the kickback-inhibiting members 10 from the inoperative positions to the operative positions, the operator may slide the operation lever 50 to the front as viewed in the cutting direction. As the operation lever 50 moves forward, the engaging projection 50*e* on the rear end of the operation lever 50 may engage the rear end of the intermediate lever 51 as shown in FIGS. 20(*a*) and 20(*b*). As the operation lever 50 further moves to the front, the intermediate lever 51 moves forward together with the operation lever 50 so that the kickback-inhibiting members 10 may be returned to the operative positions by the biasing forces of the torsion coil springs 11. As described previously, the intermediate lever 51 may also be moved forward by the biasing forces of the torsion coil springs 11 applied indirectly to the intermediate lever 51.

When the operation lever 50 and the intermediate lever 51 have returned to their forward stroke ends, they may take the positions shown in FIGS. 17(*a*) and 17(*b*), so that the kickback-inhibiting members 10 may be returned to operative positions.

According to the fifth representative kickback-inhibiting device KB5, the kickback-inhibiting members 10 may be held in the inoperative positions by the linear sliding movement of the operation lever 50. The kickback-inhibiting members 10 may also be moved from the inoperative positions to operative positions due to the sliding movement of the operation lever 50. It is not necessary to directly grip the kickback-inhibiting members 10 for the pivoting operations. As a result, the fifth representative kickback-inhibiting device KB5 is improved in operability.

In addition, in the inoperative positions the kickback-inhibiting members 10 may be located between the side portions 50*b* and 50*c* of the operation lever 50 so as to be covered by the operation lever 50. Therefore, it is possible to reliably inhibit the kickback-inhibiting members 10 from unintentional interaction with other parts or articles.

The fifth representative kickback-inhibiting device KB5 may be further modified to enable the kickback-inhibiting members 10 to be positioned at a plurality of inoperative positions by incorporating a retaining device as discussed in relation to the fourth representative embodiment.

Sixth Representative Embodiment

A sixth representative embodiment will now be described with reference to FIGS. 21 to 26. In FIGS. 21 to 26, a sixth representative kickback-inhibiting device KB6 is shown that is a modification of any of the first to fifth representative kickback-inhibiting devices KB1 to KB5. The sixth representative kickback-inhibiting device KB6 differs from these devices in that kickback-inhibiting members 60 of the sixth representative kickback-inhibiting device KB6 can be removed from a riving knife 61. In FIGS. 21 to 26, like members are given the same reference numerals as in the first to fifth representative embodiments and the description of these members may not be repeated.

The sixth representative kickback-inhibiting device KB6 has a mounting device 62 for removably mounting the kickback-inhibiting members 60 along either side of the riving knife 61.

Figure 26:
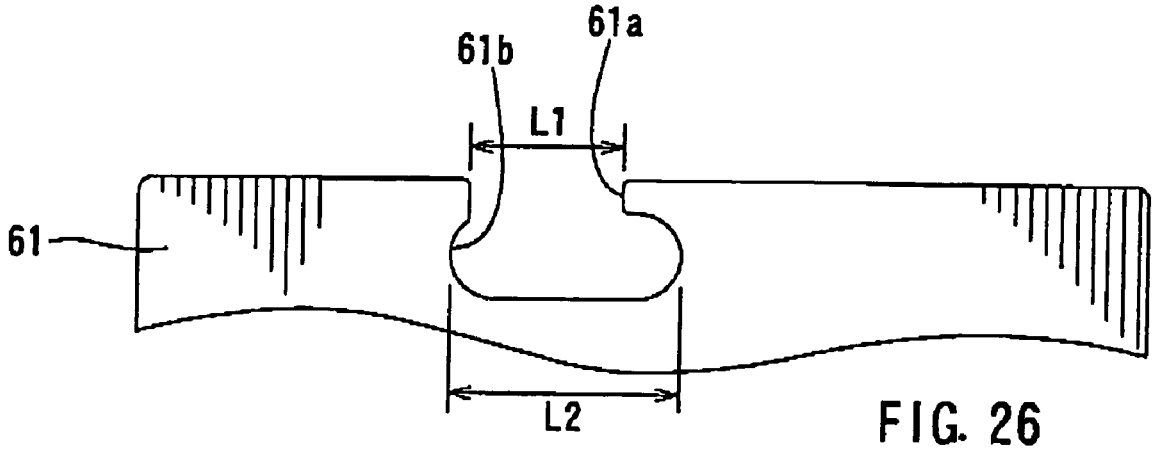
FIG. 26 is a side view of an upper portion of a riving knife according to the sixth representative embodiment and showing the state where the kickback-inhibiting members and the mounting device have been removed from the riving knife.

In the same manner as the riving knife 5 of the first to fifth representative embodiments, the riving knife 61 is positioned on the rear side of the cutting blade 4 as viewed in the cutting direction, and the riving knife 61 is aligned with the cutting blade 4. The riving knife 61 differs from the riving knife 5 in that the riving knife 61 does not have an upper bent portion as provided in the riving knife 5 as the upper bent portion 5*b*. As shown in FIG. 26, a first recess 61*a* and a second recess 61*b* are formed in continuity with each other in an upper portion of the riving knife 61 in a substantially central position with respect to the lengthwise direction (that may correspond to the cutting direction) of the riving knife 61. The first recess 61*a* and the second recess 61*b* are respectively provided for removing and mounting the riving knife 61 as will be described later. The first recess 61*a* has an upper open end at the upper edge of the riving knife 61 and is formed by cutting the riving knife 61 from its upper edge to have a length L1 in the direction with respect to the cutting direction. The second recess 61*b* is formed in continuity with the lower end of the first recess 61*a*. As shown in FIG. 26, the front and rear ends with respect to the cutting direction of the second recess 61*b* respectively have substantially semi-circular configurations. The second recess 61*b* has a length L2 with respect to the cutting direction. The length L2 is greater than the length L1 (L1<L2).

As shown in FIG. 26, the second recess 61*b* is displaced forward (rightward as viewed in FIG. 26) of the first recess 61*a*, as viewed in the cutting direction. More specifically, the center (with respect to length) of the second recess 61*b* is displaced forward of the center (with respect to length) of the first recess 61*a*.

Each of the kickback-inhibiting members 60 has a plurality of claw portions 60*a* similar to the claw portions 10*a* of the kickback-inhibiting members 10 of the first to fifth representative embodiments. In addition, each of the kickback-inhibiting members 60 has a wall portion 60*b* similar to the wall portion 10*b*. Thus, cutting and bending a part of the kickback-inhibiting member 60 forms the wall portion 60*b*. The wall portions 60*b* slidably contact with their corresponding side surface of the riving knife 61. With this arrangement, each of the kickback-inhibiting members 60 may be spaced away from the riving knife 61 by a predetermined distance via the wall portions 60*b*. Therefore, the kickback-inhibiting members 60 may be reliably prevented from intruding into the kerf of the workpiece W, so that the claw portions 60*a* may reliably engage the front end or the upper surface of the workpiece W. As a result, the kickback-inhibiting function can be reliably performed.

Figure 23:
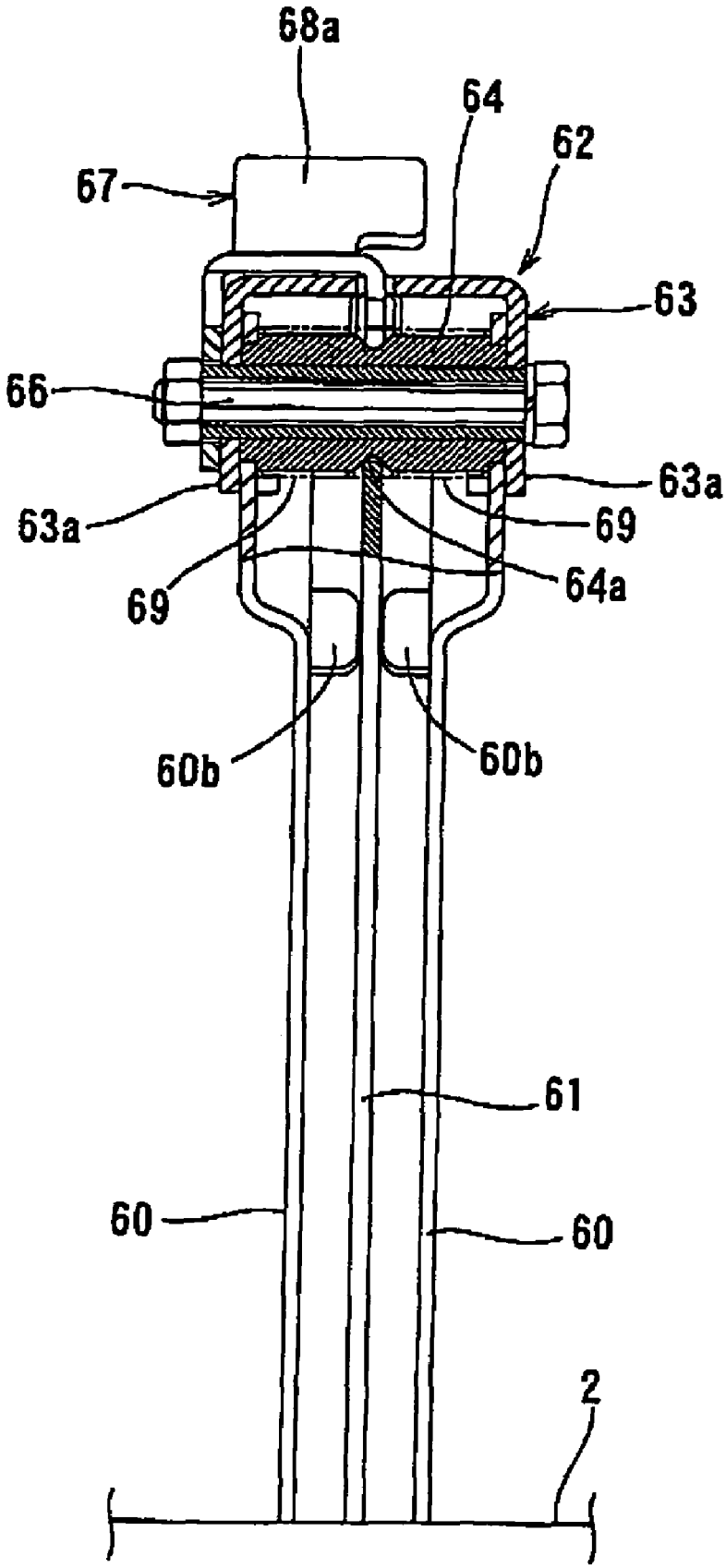
FIG. 23 is rear plan view with respect to the cutting direction shown in partial cross-section of the sixth embodiment of a kickback-inhibiting device.
Figure 24:
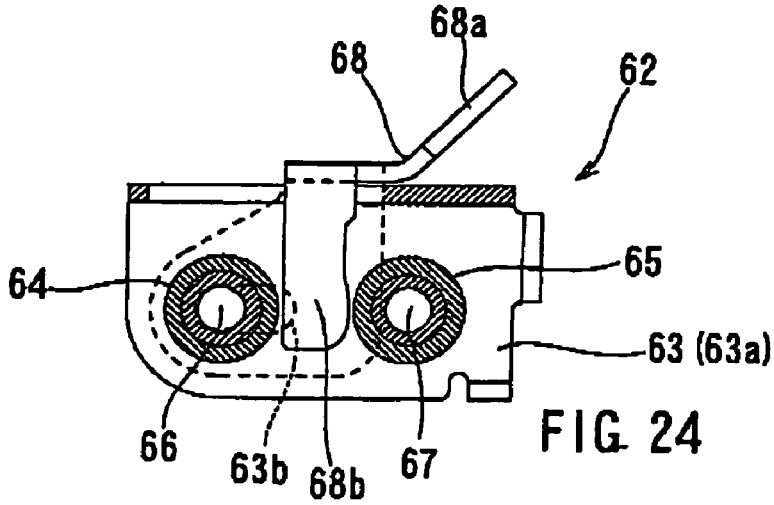
FIG. 24 is a side view of a mounting device of the kickback-inhibiting device of FIG. 22 shown in partial cross section.

As shown in FIGS. 23 and 24, the mounting device 62 has a base 63 having a substantially inverted U-shape configuration and is positioned to straddle the upper end portion of the riving knife 61. A pair of cylindrical members 64 and 65 is rotatably supported between opposite walls 63*a* of the base 63 via respective support shafts 66 and 67. Each of the cylindrical members 64 and 65 has a V-shaped engaging recess 64*a* (only one 64*a* is shown in FIG. 23) that is formed throughout the circumferential length in the outer peripheral surface of the cylindrical member 64(65) in a substantially central position with respect to the axial direction.

The support shaft 67, positioned on the front side as viewed in the cutting direction, is supported between the sidewalls 63*a* so as to not move in a radial direction. Therefore, the cylindrical member 65 positioned on the rear side may also not move in a radial direction. First ends of the kickback-inhibiting members 60 are pivotally supported on opposite axial ends of the cylindrical member 65. Torsion coil springs 69 are respectively engaged between the first ends of the kickback-inhibiting members 60 and the base 63 so that the kickback-inhibiting members 60 are biased towards the operative positions.

Opposite ends of the support shaft 66 are respectively supported by the support holes 63*b* (only one is shown in FIG. 24) that are formed in the sidewalls 63*a* of the base 63 and are elongated in the cutting direction. Therefore, the support shaft 66 and the cylindrical member 64 go through parallel displacement in forward and rearward directions within a predetermined range along the cutting direction. As a result, the cylindrical member 64 can move toward and away from the cylindrical member 65.

Figure 25:
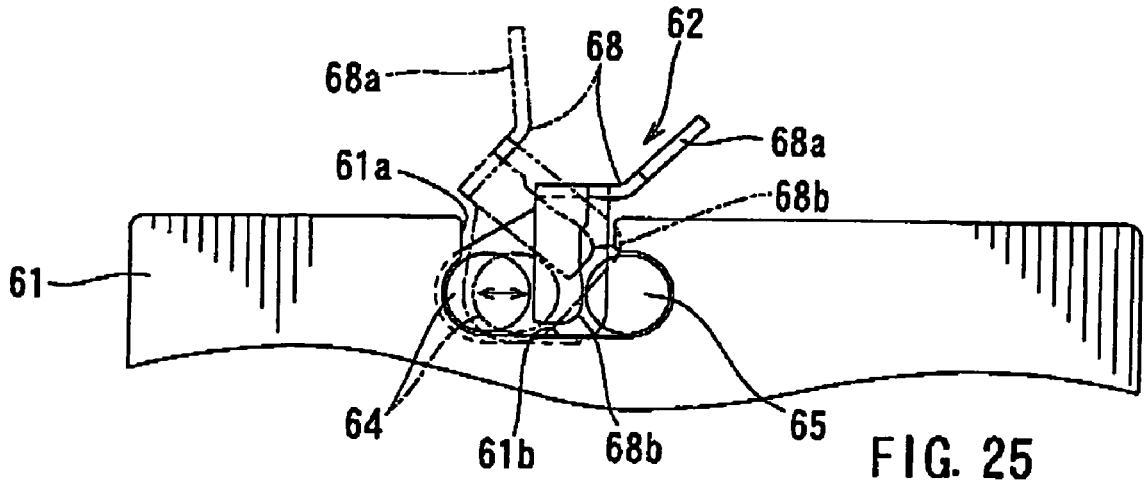
FIG. 25 is a side view of the mounting device of FIG. 22 and showing the operation for moving a front side cylindrical member by operation of a lock lever.

As shown in FIG. 25, the cylindrical members 64 and 65 may be engaged with the second recess 61*b* of the riving knife 61 in order to attach the mounting device 62 to the riving knife 61. However, by moving the cylindrical member 64 from a position on the rear side of the second recess 61*b* toward the cylindrical member 65, the cylindrical member 64 can move from the second recess 61*b* to the first recess 61*a*. By further rotating the mounting device 62 about the cylindrical member 65 positioned on the front side of the second recess 61*b*, the cylindrical member 64 positioned on the rear side may move from the second recess 61*b* to the first recess 61 and then to outside of the first recess 61*a*, so as to be removed from the riving knife 61. The cylindrical member 65 may then be moved from the second recess 61*b* to the first recess 61*a* and may also be removed from the riving knife 61.

If the rear side cylindrical member 64 is fixed in position relative to the front side cylindrical member 65 so as to be spaced apart from cylindrical member 65 such that the cylindrical members 64 and 65 respectively contact with the rear and front ends of the first recess 61*b*, the rear side cylindrical member 64 may not be able to move from the second recess 61*b* to the first recess 61*a*. Therefore, the cylindrical members 64 and 65 may be fixed in position within the second recess 61*b*. The movable range of the front side cylindrical member 64 or the length of the support holes 63*b* in the forward and rearward directions is suitably determined to enable the above operations.

A lock lever 68 is vertically pivotally supported on the support shaft 66 that is positioned on the rear side as viewed in the cutting direction. The lock lever 68 has a knob 68*a* and a lock plate 68*b*. As the operator pivots the lock lever 68 downward by gripping the knob 68*a*, the lock plate 68*b* may enter between the cylindrical members 64 and 65 and engage with the engaging recesses 64*a*. Consequently, the rear side cylindrical member 64 is moved away from the front side cylindrical member 65 by the lock plate 68*b*. The cylindrical members 64 and 65 may respectively move toward the rear and front edges of the second recess 61*b* so as to be pressed against the rear and front edges. As a result, the mounting device 62 can be fixed in position relative to the riving knife 61 with respect to a direction parallel to the surface of the riving knife 61. In addition, as the cylindrical members 64 and 65 move toward the rear and front edges of the second recess 61*b*, the engaging recesses 64*a* of the cylindrical members 64 and 65 may also engage with the front and rear edges of the second recess 61*b*. Therefore, the cylindrical members 64 and 65 and consequently the mounting device 62 can be fixed in position relative to the second recess 61*b* and relative to the riving knife 61. The mounting device 62 can be fixed in the direction perpendicular to the surface of the riving knife 61 and fixed in the direction of thickness of the riving knife 61.

With the mounting device 62 fixed in position relative to the riving knife 61, the kickback-inhibiting members 60, disposed on either side of the riving knife 61, can vertically pivot about the pivotal shaft 67. Therefore, the kickback-inhibiting members 60 can inhibit the kickback phenomenon of the workpiece W in the same manner as in the first to fifth representative embodiments.

The lock plate 68*b* may be withdrawn from the position between the cylindrical members 64 and 65 by gripping the knob 68*a* and pivoting the lock lever 68 upward. After the lock plate 68*b* has been thus withdrawn, the rear side cylindrical member 64 can move toward the front side cylindrical member 65. In order to remove the mounting device 62 from the riving knife 61, the operator may then move the entire mounting device 62 in the cutting direction, so that the rear side cylindrical member 64 may move toward the front side cylindrical member 65. The operator may then pivot the mounting device 62 about the rear side cylindrical member 65 so that the front side cylindrical member 64 may move into the first recess 61*a* along the path of an arc. Thereafter, the operator may move the mounting device 62 upward so that the rear and front side cylindrical members 64 and 65 and consequently the mounting device 62 may be removed from the riving knife 61.

The kickback-inhibiting members 60 positioned on either side of the riving knife 61 may be removed from the riving knife 61 simultaneously with the removal of the mounting device 62 from the riving knife 61. The cutting operation may then be performed without causing contact between the kickback-inhibiting members 60 and the workpiece W, which may be a decorative plywood panel for example.

As described above, according to the sixth representative kickback-inhibiting device KB6, the mounting device 62 may be fixed to the riving knife 61 by pivoting the lock lever 68 downward to move or wedge the lock plate 68*b* between the cylindrical members 64 and 65. At the same time, the kickback-inhibiting members 60, which are vertically pivotally mounted to the mounting device 62, may be positioned on either side of the riving knife 61. In addition, the kickback-inhibiting members 60 are biased in the downward direction. Consequently, the cutting operation of the workpiece W may be performed with the kickback phenomenon inhibited by the kickback-inhibiting members 60.

The mounting device 62 may be removed from the riving knife 61 by pivoting the lock lever 68 upward to withdraw the lock plate 68*b* from a position between the cylindrical members 64 and 65. The operator can then pivot the mounting device 62 upward about the front side cylindrical 65 to remove the rear side cylindrical member 64 from the first and second recess 61*a* and 61*b* of the riving knife 61. This allows the subsequent removal of the front side cylindrical member 65. With the mounting device 62 removed from the riving knife 61, the cutting operation can be performed without the risk of the kickback-inhibiting members 60 causing any damage to a workpiece W, such as a decorative plywood panel for example, in the same manner as in the first to fifth representative embodiments.

In this way, according to this representative embodiment, the kickback-inhibiting members 60 can be rapidly mounted to and removed from the riving knife 61 by the simple pivotal operation of the lock lever 68. As a result, the operability of the kickback-inhibiting device KB6 is improved.

Further, according to the sixth representative kickback-inhibiting device KB6, the kickback-inhibiting members 60 as well as the mounting device 62 can be completely removed from the riving knife 61. Therefore, it is possible to perform a groove forming operation of a workpiece that has a thickness greater than the height of the riving knife 61 as referenced from the upper surface of the table 2. Also during such a groove forming operation, the riving knife 61 can still function in order to inhibit any kickback phenomenon.

The sixth representative embodiment may be modified in various ways. For example, although the lock lever 68 is vertically pivoted about the pivotal shaft 66, the lock lever 68 may be replaced with a lock lever that can perform parallel movement in the vertical direction. In addition, the cylindrical members 64 and 65 may be replaced with prismatic members, or other geometric shapes and configurations, for example.

Furthermore, although the kickback-inhibiting members (10, 60) are supported on the riving knife (5, 61) in the above first to sixth representative embodiments, the kickback-inhibiting members (10, 60) may be supported on the cover 7 or on any other member via the kickback-inhibiting devices (KB1 to KB6).

This invention claims:

1. A kickback-inhibiting device for inhibiting a workpiece from being lifted up by a cutting blade of a cutting device, wherein the cutting blade partly extends upward from an upper surface of a table used for placing the workpiece thereon, the kickback-inhibiting device comprising:

a pair of kickback-inhibiting members each movable between an operative position where each kickback-inhibiting member is operable to engage the workpiece from an upper side in order to inhibit the workpiece from being lifted up, and an inoperative position where each kickback-inhibiting member is positioned upwardly away from the workpiece so as not to interact with the workpiece;

a holding device arranged and constructed to hold the pair of kickback-inhibiting members in the inoperative position; and a riving knife disposed on a rear side of the cutting blade, as viewed in a cutting direction of the workpiece, and aligned with the cutting blade, wherein:

the pair of kickback-inhibiting members are positioned on opposite sides of the riving knife and are vertically pivotally supported on the riving knife about a pivotal axis; and the holding device comprises:

a retaining pin mounted to the riving knife and extending in a direction of a thickness of the riving knife;

a retaining hole formed in each of the kickback-inhibiting members;

the retaining pin and the retaining holes are positioned away from the pivotal axis with respect to a radial direction of the pivotal axis such that the retaining pin and the retaining holes are positioned at substantially a same radial distance from the pivotal axis; and the retaining pin has opposite ends, each end engageable with a corresponding one of the retaining holes each of the kickback-inhibiting members in the inoperative position, only when each of the kickback-inhibiting members has pivoted upward to reach the inoperative position.

2. The kickback-inhibiting device as in claim 1, further comprising:

an operation lever vertically pivotally supported on the riving knife via the pivotal shaft, independently of each of the kickback-inhibiting members;

wherein the operation lever is operable to pivot each of the kickback-inhibiting members from the operative position to the inoperative position; and wherein the holding device is operable to engage the operation lever with the riving knife when each kickback-inhibiting members has moved to the inoperative position.

3. The kickback-inhibiting device as in claim 1, wherein the holding device is arranged and constructed to hold each of the kickback-inhibiting members in any of a plurality of inoperative positions.

4. The kickback-inhibiting device as in claim 1, further comprising:

an operation lever slidably movably mounted to the riving knife along the cutting direction, so that each of the kickback-inhibiting members move upward from the operative position to the inoperative position as the slide operation lever moves in one direction along the cutting direction, wherein the operation lever is configured to cover each of the kickback-inhibiting members at least from the upper side and opposing lateral sides when each of the kickback-inhibiting members are positioned in the inoperative position.

* * * * *